US005618661A

United States Patent [19]

Sampei

[11] Patent Number: 5,618,661

[45] Date of Patent: Apr. 8, 1997

[54] SILVER HALIDE PHOTOGRAPHIC LIGHT-SENSITIVE MATERIAL AND PROCESSING METHOD THEREFOR

[75] Inventor: Takeshi Sampei, Hino, Japan

[73] Assignee: Konica Corporation, Japan

[21] Appl. No.: 550,843

[22] Filed: Oct. 31, 1995

[30] Foreign Application Priority Data

Nov. 18, 1994 [JP] Japan ..... 6-285298

[51] Int. Cl.[6] ..... G03C 3/00

[52] U.S. Cl. ..... 430/398; 430/434; 430/435; 430/440; 430/446; 430/447; 430/264; 430/598; 430/599; 430/600; 430/603; 430/619; 430/613; 430/523; 430/531; 430/536

[58] Field of Search ..... 430/398, 434, 430/435, 440, 446, 447, 264, 598, 599, 600, 603, 611, 613, 523, 531, 536

[56] References Cited

U.S. PATENT DOCUMENTS

| | | | |
|---|---|---|---|
| 5,230,991 | 7/1993 | Nagaoka et al. | 430/393 |
| 5,441,847 | 8/1995 | Fukawa et al. | 430/446 |

FOREIGN PATENT DOCUMENTS

| | | |
|---|---|---|
| 0423712 | 4/1991 | European Pat. Off. . |
| 0608119 | 7/1994 | European Pat. Off. . |
| 0607912 | 7/1994 | European Pat. Off. . |

*Primary Examiner*—Geraldine Letscher
*Attorney, Agent, or Firm*—Jordan B. Bierman; Bierman and Muserlian

[57] ABSTRACT

A method for processing a silver halide photographic light-sensitive material by an automatic processor is disclosed. The processing method comprises the steps of (1) developing a silver halide photographic light-sensitive material with a developer being in a developing tank of said automatic processor while replenishing a developer replenisher in a rate of from 50 ml to 330 ml per square meter of the light-sensitive material processed and (2) fixing said developed silver halide photographic light-sensitive material with a fixer being in a fixing tank of said automatic processor while replenishing a fixer replenisher in a rate of from 50 ml to 330 ml per square meter of the light-sensitive material. The light-sensitive material comprises a support and at least one silver halide emulsion layer provided on a surface of a support which is a stretched film composed of a styrene copolymer having a syndiotactic structure or a composition containing said styrene copolymer.

19 Claims, No Drawings

SILVER HALIDE PHOTOGRAPHIC LIGHT-SENSITIVE MATERIAL AND PROCESSING METHOD THEREFOR

FIELD OF THE INVENTION

This invention relates to a silver halide photographic light-sensitive material and a processing method therefor, particularly relates to a light-sensitive material and a processing method therefor by which good properties can be obtained even when the light-sensitive material is processed under a condition in which the replenishing amounts of developer and fixer are reduced.

BACKGROUND OF THE INVENTION

In a silver halide photographic light-sensitive material (hereinafter simply referred as light-sensitive material), particularly in a light-sensitive material for graphic arts or that for X-ray photography, various kinds of plastic films are used as a transparency support constituting the light-sensitive material. Among them a polyester film has been usually used, which is excellent in mechanical properties thereof. Polyethylene terephthalate film is most usually used as the support by the reason of that the PET film has a high dimension stability and high elongation strength.

The light-sensitive material for graphic arts or X-ray photography are photographically processed, after exposed by light, by an automatic processor having four processing steps, i.e., developing, fixing, washing and drying. In the case of processing by such processor, the developer and fixer are usually replenished according to the processed area of light-sensitive material. It has been usual that the replenishing amounts of developer and fixer have been each 350 ml or more per square meter of light-sensitive material.

On the other hand, exhaust liquids of processing solutions cannot be discharged into a public sewerage because they contain undesirable ingredients. The exhaust liquids are recovered and destroyed by fire with a high expense and many troubles. Therefore, it is strongly demanded to reduce the amounts of exhaust liquids of photographic processing solutions. As a means for solving this problem, it is considered to reduce the replenishing amounts for the solutions being in a automatic processor.

Further, in graphic arts light-sensitive materials, photographic technologies for obtaining a ultra high contrast in the photographic properties are applied.

Among them, a light-sensitive material containing a hydrazine compound such as described in U.S. Pat. No. 4,269,929 and a light-sensitive material containing a tetrazolium compound such as described in Japanese Patent Publication Open for Public Inspection (JP O.P.I.) No. 59-79244/1984 have been known. Recently, in the field of photomechanical processing, improvement in the dot quality has been required. For instance, it is necessary to reproduce a fine dot of 25 μm or less in a high precision printing using a screen of 600 lines per inch or in a technique so called FM screening method using a screen having a random patter of uniform fine dots.

However, there is a problem that the drying property of a light-sensitive material after processing is considerably degraded when many sheets of a light-sensitive material having a polyester film support are continuously processed with a replenishing amount of not more than 330 ml per square meter of light-sensitive material for reducing the replenishing amounts of developer and fixer. It is preferable to reduce a water content in the hydrophilic colloid layer or the swelling rate of the layer for preventing the degradation in the drying property. For the above purpose, it is usually performed to reduce the amount of gelatin in the hydrophilic layer of the light-sensitive material or to increase the amount of hardener to be added to the hydrophilic colloid layer. However, when such countermeasures are applied to the light-sensitive material having a PET film support, some problems are occurred such as considerable changing in the sensitivity, increasing in fogging or changing in the gradation of the light-sensitive material. Accordingly, there is a limit on the improvement in the light-sensitive material using PET support. Further, dot quality and reproduce ability of dot images are degraded in such a method as in which fine dots of 25 μm or less are reproduced in a graphic arts light-sensitive material using the PET film support.

SUMMARY OF THE INVENTION

The object of the invention is to provide a silver halide photographic light-sensitive material and a processing thereof, by which-the drying property of the light-sensitive material after processing is not degraded, and the changing in the sensitivity, increasing in fogging and the changing in gradation are prevented even when a lot of the light-sensitive material, 10 $m^2$ or more, is processed in an automatic processor in which the developer and fixer are replenished with reduced amounts of replenishes, respectively. Another object of the invention is to provide a silver halide photographic light-sensitive material for graphic arts and a processing thereof for reproducing fine dots of 25 μm or less, by which degradation in the dot quality and that in the dot reproducibility are prevented even when a lot of the light-sensitive material, 10 $m^2$ or more, is processed in an automatic processor in which the developer and fixer are replenished with reduced amounts of replenishes, respectively. It has been found by the inventors that the above-mentioned problems in a light-sensitive material using PET film support can be surprisingly improved by making use of a support comprising a cyndiotactic styrene polymer or a composition containing a cyndiotactic styrene polymer in place of PET.

The above-mentioned objects of the invention can be attained by a method for processing a silver halide photographic light-sensitive material by an automatic processor comprising the steps of imagewise exposing a silver halide photographic light-sensitive material to light, developing the imagewise exposed light-sensitive material with a developer being in a developing tank of said automatic processor while replenishing a developer replenisher in a rate of from 50 ml to 330 ml per square meter of the light-sensitive material and fixing the developed light-sensitive material with a fixer being in a fixing tank of said automatic processor while replenishing a fixer replenisher in a rate of from 50 ml to 330 ml per square meter of the light-sensitive material, wherein the light-sensitive material comprises a support and at least one silver halide emulsion layer provided on a surface of a support which is a stretched film composed of a styrene copolymer having a syndiotactic structure or a composition containing said styrene copolymer.

DETAILED DESCRIPTION OF THE INVENTION

In the present invention, the support composed of a styrene copolymer having a syndiotactic structure (hereinafter referred as SPS) or a composition containing the syndiotactic polystyrene copolymer is a homopolymer which composed of SPS units each having a syndiotactic steric regularity. However, the polymer includes a SPS modified with a little amount, for instance not more than 20 mole %, preferably not more than 10 mole %, most preferably not more than 5 mole %, of a second component.

The modified SPS includes a SPS modified with, for example, an olefin monomer such as ethylene, propylene, butene or hexene; a cyclic olefin monomer; a cyclic diene monomer; or a polar monomer such as methyl methacrylate, maleic anhydride or acrylonitryle.

The SPS polymer is produced by polymerization of styrene or its derivative under an appropriate condition using an organic metal catalyst. The syndiotactic polystyrene has a steric regularity in racemo-diad of not less than 75%, preferably not less than 85%, further preferably 95%. The above ceramo-diad structure is preferable one having the following repeating unit, in which X is a substituent such as an alkyl group, alkoxy group, —COOM or halogen atom in which M is a mono-valent cation such as alkalimetal ion or hydrogen ion; and n is an integer of 1 to 5.

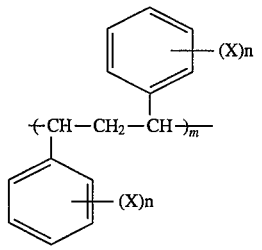

In this case, a plasticizer for plastics may be added within an amount range in which the bending elasticity of the polymer is not degraded. The plasticizer is added for obtaining an appropriate bending elasticity.

SPS can be prepared by polymerizing styrene at an appropriate temperature in the presence of a titanium compound and a condensation product trialkyl aluminum as a catalyst. The preparation of PSP can be performed referring the methods described in JP O.P.I. Nos. 62-187708/1987, 1-46912/1989 and 1-178505/1987. Although there is in limitation on the polymerization degree of SPS, ones having a polymerization degree within the range of from 10,000 to 5,000,000 are preferably used. An optimal stretching condition is necessary to raise a bending elasticity of SPS. First, a unstretched film is stretched by 3.3±0.3 times for longitudinal direction at a temperature lower than the glass transition point of the film by 30° C.±25° C., i.e., 120° C.±25° C., and then stretched for traverse direction by 3.6±0.6 times. A thermal treatment after stretching is applied at a temperature of 230° C.±18° C. A good results can be obtained when the thermal testament is applied by two steps, not only by one step. Thus a SPS film having a bending elasticity of 350 kg/mm$^2$ or more can be prepared.

As a blue tinting dye for SPS film to be used for a X-ray film, anthraquinone dyes can be used. The anthraquinone dyes may have an optional substituent at a position of 1- to 8-position of anthraquinone. Preferable substituent include an aminobenzene which may have a substituent, a hydroxyl group, a nitro group, an amino group or a hydrogen atom. At least one of the substituent is an aminobenzene which may have a substituent. The substituent of the aminobenzene ring is preferably a hydrogen atom, a halogen atom, an alkoxyl group, an alkyl group which may have a substituent, aryloxy group, an aralkyloxy group, a hydroxyalkyl group or a cyclohexylsulfonamideo group.

Although exemplified anthraquinone dyes are shown below, the dyes are not limited to them.

Exemplified compound (1) 1,4-diphenylaminoanthraquinone (2) 1,4-di(2,4,6-trimethylphenyl)anthraquinone (3) 1,4-di(2,4-diethyl-4-methylphenyl)anthraquinone (4) 1,4-di(2,4,6-trimethyl-4-cyclohexylsulfonamido-phenyl)anthraquinone (5) 1-methoxyphenylamino-4-hydroxy-5-methoxyphenyl-amino-8-hydroxyanthraquinone (6) 1,4-di(2,4,6-propylcyclohexylsulfonamidophenyl)-anthraquinone (7) 1-ethoxyphenylamino-4-hydroxy-5-methoxyphenyl-amino-8-hydtoxyanthraquinone (8) 1,4-di(2,4,6-trimethoxyphenylamino)-anthraquinone (9) 1,4-di(2,4,6-triethylphenyl)-anthraquinone

(10) 1,4-di(2,4,-di-isopropoxy-4-methylphenyl)anthraquinone

(11) 1,4-di(2,4,6-trichloro-4-hexylsulfonamidophenyl)-anthraquinone

(12) 1-(2,4,6-trimethoxyphenylamino)-4-hydroxy-5(2,4,6-trimethoryphenylamino)-8-hydroxy-anthraquinone

(13) 1,4-di(2,4,6-tripropylhexylsulfonamidophenyl)-anthraquinone

(14) 1,5-dimethoxyphenylamino-4,8-dihydroxyanthraquinone

It is difficult to adhere a photographic layer by simply coating it on the film having such a high bending elasticity. However, many patents and publications have disclosed effective methods to adhere the layer on the film as described on 3–4 pages of JP O.P.I. No. 3-54551/1991.

Regarding surface treatment, for example, a corona discharge treatment method and a subbing layer coating method are disclosed. As subbing layer, vinylidene chloride, methacrylic acid, acrylic acid, itaconic acid and maleic anhydride are described.

The thickness of the support is preferably 50 to 250 μm, more preferably 70 to 200 μm.

The silver halide photographic light-sensitive material relating to the invention is processed after exposure by an automatic processor having at least four processed, i.e., developing, fixing, washing or stabilizing and drying.

During the processing, the developer and fixer are each replenished with a developer replenisher and a fixer replenisher, respectively, in the amounts proportional to the area of a light-sensitive material. The amounts of the developer replenisher and the fixer replenisher are each within the range of from 50 ml to 330 ml per square meter of the light-sensitive material. The amounts are preferably each within the range of from 75 to 200 ml per square meter of light-sensitive material. Here, the amount of developer replenisher and that of fixer replenisher are defined as the replenishing amount of each of the solutions. In concrete, the amounts of developer replenisher and fixer replenisher are each of the amount of the solutions to be supplied, when the solutions are each the same as the working developer solution and the working fixer solution, respectively. When a diluted solution of a concentrated developer and a diluted solution of a concentrated fixer are used as replenishing solutions, the replenishing amount of the solutions are each the sum of the amount of the concentrated solution and water used for dilution. When solutions which are each prepared by dissolving a solid developing composition and a solid fixing composition in water, respectively, are used as replenishes, each of the replenishing amount of them is the volume of the solution composed of the solid composition and water used for dissolution. When a solid developing composition and a solid fixing composition are each supplied together with water, each of the replenishing amount of them is the volume of the solution composed of the solid composition and water supplied together with the solid composition. When the replenisher is supplied in a form of solid composition, the replenishing amount is expressed by the volume of the solution composed of the solid composition to be directly supplied to the processing tank of an automatic processor and replenishing water to be separately supplied to the tank. The developer replenisher and the fixer replenisher may be solutions or solid compositions each the same or different from the working developer solution or working fixer solution each filled in the tanks of the processor. When the amount of developer replenisher is not ore than 120 ml pre square meter of light-sensitive material, it is preferable that the replenishing solution is different from the working developer solution filled in the tank of the processor, and the amount of a silver sludge preventing agent having a mercapto group contained in the replenisher is preferably larger than that in the working developer. Particularly, when the amount of fixer replenisher is not more than 150 ml per square meter of light-sensitive material, it is preferable that the fixer replenisher and developer replenisher are a solution or a solid composition different from the fixer working solution in the tank of the processing machine, and the thiosulfate content in the fixer replenisher is preferably larger than that in the working fixer solution.

Developing agents usable in the present invention include those disclosed in Items A and B on page 29 of Research Disclosure Vol. 126, 17643, December, 1978. It is preferable for enhancing the effects of the invention that the developer contains substantially no hydroxybenzene compound and contains a compound represented by the following Formula (I).

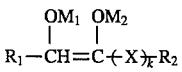

Formula (I)

In the formula $R_1$ and $R_2$ represent each independently an alkyl group, an amino group or analkylthio group, $R_1$ and $R_2$ may belinked together to form a ring; k represents 0 or 1; and X represents —CO— or —CS—, when k=1; $M_1$ and $M_2$ represent each a hydrogen atom or an alkali metal atoms. The alkyl group, amino group and alkylthio group each may have a substituent.

Preferable substituents of the above-mentioned alkyl group represented by $R_1$ or $R_2$ are, for example, a halogen atom such as a chlorine atom or bromine atom, a hydroxyl group, an aryl group having 6 to 20 carbon atoms such as a phenyl group or naphthyl group, a heterocyclic group such as a 2,2,6,6-tetramethylpiperidinyl group, quinolidinyl group, N,N-diethylpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino or propinonyla/nino group, and an amino group such as an amino group, methylamino group, dimetylamino group or dibenzylamino group.

Preferable substituents of the above-mentioned amino group represented by $R_1$ or $R_2$ are, for example, a halogen atom such as a chlorine atom or bromine atom, a hydroxyl group, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, and an acyl group having 1 to 20 carbon atoms such as an acetyl group, heptanoyl group or propinonyl group.

Preferable substituents of the above-mentioned alkylthio group represented by $R_1$ or $R_2$ are, for example, a halogen atom such as a chlorine atom or bromine atom, a hydroxyl group, an aryl group having 6 to 20 carbon atoms such as a phenyl group or naphthyl group, a heterocyclic group such as a 2,2,6,6-tetramethyl-piperidinyl group, quinolidinyl group, N,N-diethylpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Among the compounds represented by Formula (I), compounds represented by the following Formula (I-*a*) are preferable, in which $R_1$ and $R_2$ of Formula I are linked together to form a ring.

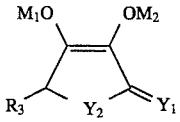

Formula (I-a)

In the formula, $R_3$ represents an alkyl group, an aryl group, an alkoxyl group, a sulfo group, a carboxyl group, an amido group or a sulfonamido group; $Y_1$ represents O or S; $Y_2$ represents O, S or $NR_4$, $R_4$ represents an alkyl group or an aryl group. The groups represented by $R_3$ or $R_4$ each may have a substituent.

Preferable substituents of the above-mentioned alkyl group and alkylthio group represented by $R_4$ are each the same as those described about alkyl group and alkylthio group represented by $R_1$ or $R_2$ of Formula (I), respectively.

Preferable substituents of the above-mentioned aryl group represented by $R_3$ are, for example, a halogen atom such as a chlorine atom or bromine atom, a hydroxyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethylpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Preferable substituents of the above-mentioned alkyloxy group represented by $R_3$ are, for example, a halogen atom such as a chlorine atom or bromine atom, a hydroxyl group, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an aryloxy group having 6 to 20 carbon atoms such as a phenoxy group, an alkenyloxy group having 1 to 20 carbon atoms such as an allyloxy group, an atkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Preferable substituents of the above-mentioned sulfo group, carboxy group, amido group or sulfonamido group each represented by $R_3$ are, for example, a halogen atom such as a chlorine atom or bromine atom, a hydroxyl group, an alkali metal atom such as a sodium atom or potassium atom, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Although exemplified compounds of Formula (I) or (I-*a*) are described below, the invention is not limited thereby.

| | Formula (I) | | | | |
|---|---|---|---|---|---|
| Compound No. | X | $R_1$ | $R_2$ | $M_1$ | $M_2$ |
| A-1 | — (k = 0) | $HOCH_2CH(OH)-CH(OH)-$ | $-OH$ | H | H |
| A-2 | — (k = 0) | $HOCH_2CH(OH)-CH(OH)-$ | $-OH$ | H | Na |
| A-3 | — (k = 0) | $HOCH_2CH(OH)-CH(OH)-$ | $-CH_3$ | H | H |
| A-4 | — (k = 0) | $HOCH_2CH(OH)-CH(OH)-$ | $-C_2H_5$ | H | H |
| A-5 | — (k = 0) | $CH_3CH(OH)-CH(OH)-$ | $-OH$ | H | H |
| A-6 | — (k = 0) | $CH_3CH(OH)-CH(OH)-$ | $-OH$ | H | Na |
| A-7 | — (k = 0) | $CH_3CH(OH)-CH(OH)-$ | $-CH_3$ | H | H |
| A-8 | — (k = 0) | $CH_3CH(OH)-CH(OH)-$ | $-CH_3$ | Na | H |
| A-9 | — (k = 0) | $CH_3CH(OH)-CH(OH)-$ | $-C_2H_5$ | H | H |
| A-10 | $-C(=O)-$ (k = 1) | $HOCH_2CH(OH)-CH(OH)-$ | $-OH$ | H | H |
| A-11 | $-C(=O)-$ (k = 1) | $HOCH_2CH(OH)-CH(OH)-$ | $-OH$ | Na | H |

-continued

| Compound No. | X | $R_1$ | $R_2$ | $M_1$ | $M_2$ |
|---|---|---|---|---|---|
| | Formula (I) | | | | |
| A-12 | $-\overset{O}{\overset{\|\|}{C}}-$ (k = 1) | $HOCH_2\underset{OH}{\underset{\|}{CH}}-\underset{OH}{\underset{\|}{CH}}-$ | $-CH_3$ | H | H |
| A-13 | $-\overset{O}{\overset{\|\|}{C}}-$ (k = 1) | $HOCH_2\underset{OH}{\underset{\|}{CH}}-\underset{OH}{\underset{\|}{CH}}-$ | $-CH_3$ | H | Na |
| A-14 | $-\overset{O}{\overset{\|\|}{C}}-$ (k = 1) | $HOCH_2\underset{OH}{\underset{\|}{CH}}-\underset{OH}{\underset{\|}{CH}}-$ | $-C_2H_5$ | H | H |
| A-15 | $-\overset{O}{\overset{\|\|}{C}}-$ (k = 1) | $CH_3\underset{OH}{\underset{\|}{CH}}-\underset{OH}{\underset{\|}{CH}}-$ | $-OH$ | H | H |
| A-16 | $-\overset{O}{\overset{\|\|}{C}}-$ (k = 1) | $CH_3\underset{OH}{\underset{\|}{CH}}-\underset{OH}{\underset{\|}{CH}}-$ | $-OH$ | Na | H |
| A-17 | $-\overset{O}{\overset{\|\|}{C}}-$ (k = 1) | $CH_3\underset{OH}{\underset{\|}{CH}}-\underset{OH}{\underset{\|}{CH}}-$ | $-CH_3$ | H | H |
| A-18 | $-\overset{O}{\overset{\|\|}{C}}-$ (k = 1) | $CH_3\underset{OH}{\underset{\|}{CH}}-\underset{OH}{\underset{\|}{CH}}-$ | $-C_2H_5$ | H | H |
| A-19 | $-\overset{O}{\overset{\|\|}{C}}-$ (k = 1) | $HO-CH_2-$ | $-OH$ | H | H |
| A-20 | $-\overset{O}{\overset{\|\|}{C}}-$ (k = 1) | $HO-CH_2-$ | $-OH$ | H | Na |
| A-21 | $-\overset{O}{\overset{\|\|}{C}}-$ (k = 1) | $HO-CH_2-$ | $-CH_3$ | H | H |
| A-22 | $-\overset{O}{\overset{\|\|}{C}}-$ (k = 1) | $HO-CH_2-$ | $-C_2H_5$ | H | H |
| A-23 | $-\overset{O}{\overset{\|\|}{C}}-$ (k = 1) | $HO-CH_2-$ | $-C_2H_4OH$ | H | H |
| A-24 | $-\overset{O}{\overset{\|\|}{C}}-$ (k = 1) | $HO-CH_2-$ | $-C_2H_4OH$ | H | Na |
| A-25 | $-\overset{S}{\overset{\|\|}{C}}-$ (k = 1) | $HOCH_2\underset{OH}{\underset{\|}{CH}}-\underset{OH}{\underset{\|}{CH}}-$ | $-OH$ | H | H |
| A-26 | $-\overset{S}{\overset{\|\|}{C}}-$ (k = 1) | $HOCH_2\underset{OH}{\underset{\|}{CH}}-\underset{OH}{\underset{\|}{CH}}-$ | $-OH$ | H | Na |
| A-27 | $-\overset{S}{\overset{\|\|}{C}}-$ (k = 1) | $HOCH_2\underset{OH}{\underset{\|}{CH}}-\underset{OH}{\underset{\|}{CH}}-$ | $-CH_3$ | H | H |
| A-28 | $-\overset{S}{\overset{\|\|}{C}}-$ (k = 1) | $CH_3\underset{OH}{\underset{\|}{CH}}-\underset{OH}{\underset{\|}{CH}}-$ | $-OH$ | H | H |
| A-29 | $-\overset{S}{\overset{\|\|}{C}}-$ (k = 1) | $CH_3\underset{OH}{\underset{\|}{CH}}-\underset{OH}{\underset{\|}{CH}}-$ | $-OH$ | H | Na |
| A-30 | $-\overset{S}{\overset{\|\|}{C}}-$ (k = 1) | $CH_3\underset{OH}{\underset{\|}{CH}}-\underset{OH}{\underset{\|}{CH}}-$ | $-CH_3$ | Na | H |

Formula (I-a)

| Compound No. | $Y_1$ | $Y_2$ | $R_3$ | $M_1$ | $M_2$ |
|---|---|---|---|---|---|
| A-31 | O | O | H | H | H |
| A-32 | O | O | $CH_3$ | H | H |
| A-33 | O | O | $CH_3$ | H | Na |
| A-34 | O | O | $CH_3$ | Na | H |
| A-35 | O | O | $CH_2$<br>\|<br>OH | H | H |
| A-36 | O | O | $CH_2$<br>\|<br>OH | H | Na |
| A-37 | O | O | $CH_3CH$—<br>\|<br>OH | H | H |
| A-38 | O | O | $CH_3CH$—<br>\|<br>OH | H | Na |
| A-39 | O | O | $HOCH_2CH$—<br>\|<br>OH | H | H |
| A-40 | O | O | $HOCH_2CH$—<br>\|<br>OH | H | Na |
| A-41 | O | O | $HOCH_2CH$—<br>\|<br>OH | Na | H |
| A-42 | O | O | $ClCH_2CH$—<br>\|<br>OH | H | H |
| A-43 | O | O | $ClCH_2CH$—<br>\|<br>OH | Na | H |
| A-44 | O | O | $HOOCH_2CH$—<br>\|<br>OH | H | H |
| A-45 | O | O | $HOOCH_2CH$—<br>\|<br>OH | Na | H |
| A-46 | S | O | H | H | H |
| A-47 | S | O | H | H | Na |
| A-48 | S | O | $CH_3CH$—<br>\|<br>OH | H | H |
| A-49 | S | O | $CH_3CH$—<br>\|<br>OH | Na | H |
| A-50 | S | O | $HOCH_2CH$—<br>\|<br>OH | H | H |
| A-51 | S | O | $HOCH_2CH$—<br>\|<br>OH | Na | H |
| A-52 | O | $NCH_3$ | H | H | H |
| A-53 | O | $NCH_3$ | $HOCH_2CH$—<br>\|<br>OH | H | H |
| A-54 | O | $NCH_3$ | $HOCH_2CH$—<br>\|<br>OH | H | Na |

-continued

Formula (I-a)

| Compound No. | $Y_1$ | $Y_2$ | $R_3$ | $M_1$ | $M_2$ |
|---|---|---|---|---|---|
| A-55 | O | NH | $HOCH_2CH$—<br>\|<br>OH | H | H |
| A-56 | O | NH | $HOCH_2CH$—<br>\|<br>OH | Na | H |
| A-57 | O | S | $HOCH_2CH$—<br>\|<br>OH | H | H |
| A-58 | O | S | $HOCH_2CH$—<br>\|<br>OH | Na | H |
| A-59 | O | S | $HOCH_2CH$—<br>\|<br>OH | H | Na |
| A-60 | O | S | $CH_3CH$—<br>\|<br>OH | H | H |
| A-61 | S | S | H | H | H |
| A-62 | S | S | H | H | Na |
| A-63 | S | S | $CH_3CH$—<br>\|<br>OH | H | H |
| A-64 | S | S | $CH_3CH$—<br>\|<br>OH | Na | H |
| A-65 | S | S | $HOCH_2CH$—<br>\|<br>OH | H | H |
| A-66 | S | S | $HOCH_2CH$—<br>\|<br>OH | H | Na |
| A-67 | S | S | $HOCH_2CH$—<br>\|<br>OH | Na | H |
| A-68 | S | S | $HOCH_2CH$—<br>\|<br>OH | H | K |

These compounds are typically ascorbic acid, erthorbic acid and their derivatives, which are available on the market or easily can be synthesized by a well-known synthesizing method.

As an assistance developing agent which shows a super-additivity effect with the compound represented by Formula (I), a 3-pyrazolidone derivative and a p-aminophenol derivative are usable. These compounds are well known as assistance developing agents. Although the compounds are exemplified below, the compounds are not limited thereby.

1-phenyl-3-pyrazolidone 1-phenyl-4,4'-dimethyl-3-pyrazoiidone 1-phenyl-4-methyl-4-hydroxtmethyl-3-pyrazolidone 1-phenyl-5-methyl-3-pyrazolidone 1-p-aminophenyl-4,4'-dimethyl-3-pyrazolidone 1-p-tolyl-4,4'-dimethyl-3-pyrazolidone 1-p-tolyl-4-methyl-4-hydroxymethyl-3-pyrazolidone N-methyl-p-aminophenol N-(β-hydroxyethyl)-p-aminophenol N-(4-hydroxyphenyl)glycine 2-methyl-p-aminophenol p-benzylaaminophenol As another means for enhancing the effect of the invention, it is preferable that the developer contains substantially no dihydroxybenzene compound and that the developer contains transition metal complex salt as a developing agent.

The transition metal complex salt usable as developing agent in the invention includes complex salts of transition metal such as Ti, V, Cr, Mn, Fe, Co, Ni and Cu, in which those of Ti, V, Cr, and Fe are preferable. These compounds should be ones having a reducing ability, for example, complex salts of $Ti^{3+}$, $V^{2+}$, $Cr^{2+}$ and $Fe^{2+}$ are known as developing agent. As ligands, for example, aminopolycarboxylic acid such as ethylenediaminetetraacetic acid (EDTA) and diethylenetriaminepentaacetic acid (DTPA) and their salts, and phosphoric acid such as hexamethapolyphosphoric acid, tetrapolyphosphoric acid and their salts are described. Among them, transition metal complex salts each having a ligand of EDTA or DTPA are preferably used.

Examples of preferable ligands are shown below, but usable ligands are not limited thereby.

(1) Ethylenediaminetetraacetic acid (EDTA)

(2) Diethylenetriaminepentaacetic acid (DTPA)

(3) Triethylenetetraminehexaacetic acid (TTHA)

(4) Hydroxyethylethylenediaminetriacetid acid (HEDTA)

(5) Nitrylotriacetic acid (NTA)

(6) 1,2-diaminocyclohexanetetraacetic acid (7) 1,3-diamino-2-propanoltetraacetic acid (8) Hexametapolyphosphic acid (9) Tetrapolyphosphic acid Preferable examples of compounds other than the above are those described on pages 128(2) to 129(3) of Japanese Patent No. 54-41899/1979.

The complex relating to the invention, may be produced in a developer by adding a transition metal salt and ligand compound to the developer. The preferable content of the compound relating to the invention in the developer is 1 to 100 g per liter.

In the present invention, it is preferable that the developer substantially does not contain any hydroquinone compound such as hydroquinone, bromohydroquinone, methylhydroquinone or hydroquinonemonosulfonate. "Substantially does not contain" means that the content is less than 0.01 mole per liter.

In the invention, the developing agent of transition metal complex salt may be used in combination with a developing agent of 3-pyrazolidones such as 1-phenyl-3-pyrazolidone, 1-phenyl-4-methyl-3-pyrazolidone, 1-phenyl-4,4'-dimethyl-3-pyrazolidone, 1-phenyl-4-ethyl-3-pyrazolidone and 1-phenyl-5-methyl-3-pyrazolidone, or aminophenols such as oaminophenol, p-aminophenol, N-methyl-o-aminophenol, N-methyl-p-aminophenol and 2,4-diaminophenol. When the developing agents are used in combination, a developing agent of 3-pyrazolidones or aminophenols is preferably contained in the developer in an amount of 0.01 to 1.4 mole per liter.

In the developer, a silver sludge preventing agent described in JP No. 62-4702/1987, JP O.P.I. Nos. 3-51884/1991, 4-26838/1992, 4-362942/1992 and 1-319031/1989 is preferably contained. Further, it is more preferable to add a compound represented by the following Formula (2) to the developer for enhancing the effects of the invention.

Formula (2) $Z_1$-$SM_1$

In the formula, $Z_1$ represents an alkyl group, an aromatic group or a heterocyclic group, each of which has a substituent selected from the group consisting of a hydroxyl group, $—SO_3M_1'$, $—COOM_1'$, in which $M_1'$ is a hydrogen atom, an alkali metal atom or an ammonium ion, an amino group and an ammonio group, or a group substituted with at least one substituent selected from the above group. $M_1$ represents a hydrogen atom, an alkali metal atom, an amidino group which may be in a form of a hydrogen halide salt or a sulfonate. The ammonio group is one having 20 or less carbon atoms and the substituent thereof includes a straight-chain, branched- chain or cyclic alkyl group such as a methyl group, an ethyl group, a benzyl group, an ethoxypropyl group or cyclohexyl group, a phenyl group and naphthyl group.

The above-mentioned ammonium ion, amino group, ammonio group and amidino group each may have a substituent. Preferable substituents of the ammonium ion, amino group, ammonio group or amidino group are, for example, a halogen atom such as a chlorine atom or bromine atom, a hydroxyl group, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, and an acyl group such as an acetyl group, heptanoyl group or propionyl group.

An alkyl group represented by $Z_1$ in Formula (2) is preferably one having 1 to 30, particularly a straight-chain, branched-chain or cyclic alkyl group each having 2 to 20 carbon atoms, which may further have a substituent other that the above-mentioned. An aromatic group represented by $Z_1$ is preferably a single- or condensed-ring compound having 6 to 22 carbon atoms which may further has a substituent other that the above-mentioned. An heterocyclic group represented by $Z_1$ is preferably a single- or condensed ring-compound having 6 to 32 carbon atoms and a five- or six-member ring including 1 to 6 hetero atoms independently selected from nitrogen, oxygen and sulfur, which may further has a substituent other that the above-mentioned. However, when the heterocyclic group is a tetrazole group, the group has no a substituted or unsubstituted naphthyl group as a substituent thereof. $Z_1$ is preferably a heterocyclic group having two or more nitrogen atoms.

Among the compounds represented by Formula (2), compounds represented by the following Formula (2-a), (2-b) or (2-c) are more preferable.

Formula (2-a)

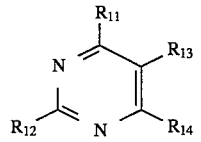

In the formula, $R_{11}$, $R_{12}$, $R_{13}$ and $R_{14}$ are each independently a hydrogen atom, a halogen atom, an alkyl group, an alkoxyl group, an aryl group, an aralkyl group, a hydroxyl group, a mercapto group, a carboxyl group, a sulfo group, a phosphono group, an amino group, a nitro group, a cyano group, an alkoxycarbonyl group, an aryloxycarbonyl group, a carbamoyl group or a sulfamoyl group, provided that at least one of $R_{11}$, $R_{12}$, $R_{13}$ and $R_{14}$ is a mercapto group and at least one of $R_{11}$, $R_{12}$, $R_{13}$ and $R_{14}$ other than one representing the mercapto group is a hydroxyl group or an amino group. $R_{13}$ and $R_{14}$ may be linked to form a saturated or unsaturated ring.

Formula (2-b)

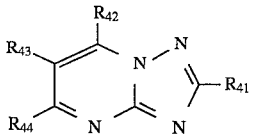

Formula (2-c)

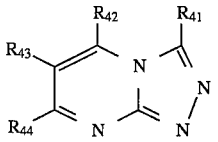

In Formulas (2-b) and (2-c), $R_{41}$, $R_{42}$, $R_{43}$ and $R_{44}$ are each independently a hydrogen atom, an —$SM_{41}$ group, a hydroxyl group, an alkoxyl group having 1 to 5 carbon atoms, a —$COOM_{42}$ group, an amino group, an —$SO_3M_{43}$ group or an alkyl group having 1 to 5 carbon atoms, and at least one of $R_{41}$, $R_{42}$, $R_{43}$ and $R_{44}$ is an —$SM_{41}$ group. $M_{41}$, $M_{42}$ and $M_{43}$ are each a hydrogen atom, an alkali metal atom or an ammonium group, they may be the same or different.

In the above Formulas (2-b) and (2-c), the alkyl group and alkoxyl group each represented by $R_{41}$, $R_{42}$, $R_{43}$ or $R_{44}$ are ones having 1 to 5 carbon atoms, they each may have a substituent preferably having 1 to 3 carbon atoms. An amino group represented by a $R_{41}$, $R_{42}$, $R_{43}$ or $R_{44}$ is a substituted or unsubstituted amino group and a preferable substituent thereof is a lower alkyl group.

In the above Formulas (2-b) and (2-c), the ammonium group is a substituted or unsubstituted, preferably a unsubstituted, ammonium group.

Although examples of the compounds are shown below, the compounds are not limited thereby.

Examples of compounds of Formula (2-a)

1-1

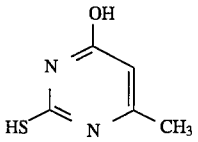

1-2

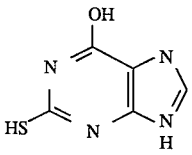

1-3

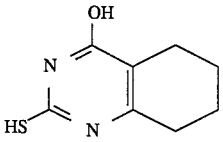

1-4

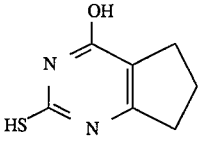

-continued 1-5

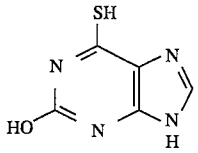

1-6

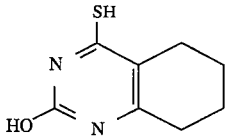

1-7

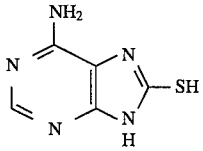

1-8

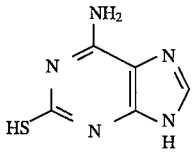

Examples of compounds of Formula (2-b)

| | $R_{41}$ | $R_{42}$ | $R_{43}$ | $R_{44}$ |
|---|---|---|---|---|
| 2-b-1 | —SH | H | H | H |
| 2-b-2 | —SH | —OH | H | H |
| 2-b-3 | —SH | H | —OH | H |
| 2-b-4 | —SH | —$CH_2$ | —OH | H |
| 2-b-5 | —SH | —$NH_2$ | H | H |
| 2-b-6 | —SH | H | H | —$NH_2$ |
| 2-b-7 | —SH | H | —$CH_3$ | —$CH_3$ |
| 2-b-8 | —SH | H | H | —SH |
| 2-b-9 | —SH | —OH | H | —SH |
| 2-b-10 | —SH | H | H | —COOH |
| 2-b-11 | H | —SH | H | H |
| 2-b-12 | —SH | —SH | H | H |
| 2-b-13 | H | —SH | —OH | H |
| 2-b-14 | H | —SH | —$NH_2$ | H |
| 2-b-15 | H | —SH | —OH | —$CH_3$ |
| 2-b-16 | H | —SH | —$NH_2$ | —$C_2H_5$ |
| 2-b-17 | H | —SH | H | —$CH_3$ |
| 2-b-18 | H | —SH | H | —OH |
| 2-b-19 | H | —SH | H | —COOH |
| 2-b-20 | H | —SH | H | —$SO_3H$ |
| 2-b-21 | H | H | —SH | H |
| 2-b-22 | —OH | H | —SH | H |
| 2-b-23 | —OH | —CH-3 | —SH | H |
| 2-b-24 | —$NH_2$ | H | —SH | H |
| 2-b-25 | —SH | H | —SH | H |
| 2-b-26 | H | H | H | —SH |
| 2-b-27 | H | —OH | H | —SH |
| 2-b-28 | —OH | H | H | —SH |
| 2-b-29 | —$NH_2$ | H | H | —SH |
| 2-b-30 | H | —$NH_2$ | H | —SH |
| 2-b-31 | H | —$NH_2$ | —$CH_3$ | —SH |
| 2-b-32 | —SH | H | H | —SH |
| 2-b-33 | —SH | —$CH_3$ | H | —SH |
| 2-b-34 | H | —$OCH_3$ | H | —SH |
| 2-b-35 | —SH | —SH | H | —SH |
| 2-b-36 | H | —$CH_3$ | —$CH_3$ | —SH |

Examples of compounds of Formula (2-c)

| | $R_{41}$ | $R_{42}$ | $R_{43}$ | $R_{44}$ |
|---|---|---|---|---|
| 2-c-1 | H | H | —$NH_2$ | —SH |
| 2-c-2 | H | —$CH_3$ | —$NH_2$ | —SH |

-continued

| | $R_{41}$ | $R_{42}$ | $R_{43}$ | $R_{44}$ |
|---|---|---|---|---|
| 2-c-3 | H | H | —SH | —SH |
| 2-c-4 | —OH | H | —SH | —SH |
| 2-c-5 | H | H | —COOH | —SH |
| 2-c-6 | H | H | H | —SH |
| 2-c-7 | —OH | H | H | —SH |
| 2-c-8 | H | —OH | H | —SH |
| 2-c-9 | $—CH_3$ | —OH | H | —SH |
| 2-c-10 | $—NH_2$ | H | H | —SH |
| 2-c-11 | —OH | H | —SH | H |
| 2-c-12 | $—NH_2$ | H | —SH | H |
| 2-c-13 | —OH | $—CH_3$ | —SH | H |
| 2-c-14 | $—NH_2$ | $—C_2H_5$ | —SH | H |
| 2-c-15 | H | $—CH_3$ | —SH | H |
| 2-c-16 | H | —OH | —SH | H |
| 2-c-17 | H | H | —SH | H |
| 2-c-18 | —OH | H | —SH | $—CH_3$ |
| 2-c-19 | —OH | $—CH_3$ | —SH | H |
| 2-c-20 | $—NH_2$ | H | —SH | H |
| 2-c-21 | —SH | H | —SH | H |
| 2-c-22 | H | —SH | H | —OH |
| 2-c-23 | H | —SH | —OH | $—NH_2$ |
| 2-c-24 | H | —SH | $—NH_2$ | H |
| 2-c-25 | H | —SH | —COOH | H |
| 2-c-26 | H | —SH | H | H |
| 2-c-27 | $—OCH_3$ | —SH | H | H |
| 2-c-28 | H | —SH | H | $—SO_3H$ |
| 2-c-29 | —SH | H | H | H |
| 2-c-30 | —SH | —OH | H | H |
| 2-c-31 | —SH | H | H | $—NH_2$ |
| 2-c-32 | —SH | $—CH_3$ | H | H |

The adding amount of a compound represented by Formula (2) is preferably $10^{-6}$ to $10^{-1}$ moles, more preferably $10^{-5}$ to $10^{-2}$ moles, per liter of a developer. In the present invention, sulfites and metabisulfites are usable as a preservative include sodium sulfite, potassium sulfite, ammonium sulfite and sodium metabisulfite. The content of sulfite is preferably 0.25 moles, particularly 0.4 moles or more, per liter.

An alkaline agent such as sodium hydroxide and potassium hydroxide, pH buffer such as carbonates, phosphates, boric acid, acetic acid, citric acid or alkanolamine, a dissolving aid such as a polyethylene glycols and esters thereof and an alkanolamine, a sensitizing agent such as a nonionic surfactants including polyoxyethylenes or a quartenary ammonium compounds, a surfactant, a defoaming agent, an antifoggant such as halide salts including potassium bromide and sodium bromide, nitrobenzimidazole, nitrobenzimidazole, benzotriazole, benzothiazole, tetrazoles and thiazoles, a chelating agent such as ethylenediaminetetraacetic acid and its alkali salts, nitrylotriacetates and poll/phosphates, a development accelerator such as compounds described in U.S. Pat. No. 2,304,025 and JP No. 47-45541, a hardener such as glutaraldehyde and its adducts with bisulfite may be added to the developer according to an necessity. The pH value of developer is preferably adjusted to within the range of from 7.5 to 10.5.

The developer can be regenerated by applying an electric current. In concrete, a cathode made of an electric conductor such as a stainless steel wool, or a semiconductor and a anode made of an insoluble electric conductor such as carbon, gold, platinum or titanium, are provided in a developer to be regenerated and a solution of an electrolyte, respectively. The tank of the developer to be regenerated and the tank of the solution of electrolyte are being contacted through an anionic ion-exchange membrane, and an electric current supplied to the electrodes to regenerate the developer. The light-sensitive material of the invention can be processed while the developer is regenerated. At the time of regeneration, various addenda to be added to a developer such as preservatives, alkaline agents, pH buffers, sensitizing agents, antifoggant, silver sludge preventing agents can be replenished to the developer. The above addenda can be supplied to the developer also in a course of processing of the light-sensitive material while applying an electric current for regeneration. When the developer is regenerated, the transition metal complex salts are preferably used as the developing agents.

As the fixer, one having a usual composition can be used. The fixer is usually a solution comprising a fixing agent and other components, and the pH value thereof is usually 3.8 to 5.8. As the fixing agent, sulfates such as sodium thiosulfate, potassium thiosulfate and ammonium thiosulfate, thiocyanates such as sodium thiocyanate, potassium thiocyanate and ammonium thiocyanate, and organic sulfur compounds known as fixing agents which are each able to form a soluble stable silver complex salt, can be used.

It is preferable that any water-soluble aluminum compound effective as a hardener, such as aluminum chloride, aluminum sulfate or potassium alum, is substantially not contained in the fixer. In the invention, "substantially not contained" means the amount of the aluminum salt is not more than 0.01 moles per liter of the fixer. In the fixer, an aldehyde compound such as glutaraldehyde or its adducts with sulfite, can be used as a hardener. A fixer containing no hardener can also be used.

According to a necessity, the fixer may contains, conservatives such as sulfites and bisulfites, pH buffers such as acetic acid, pH adjusting agents such as sulfuric acid and a chelating agents having a water softening ability.

As a method of enhancing effects of the invention, it is preferable to use a developer and a fixer each prepared by dissolving a solid processing composition of developer and that of fixer, respectively, in water.

In the invention, the "solid processing composition" is a solid composition in a form of powder, tablet, pill or granule, which are subjected to a moisture proof treatment if necessary. Compositions in a form of a past or slurry which is deteriorate in the storage stability, and ones in a form which is regulated by the reason that the composition causes danger during transportation thereof are excluded from the compositions of the invention.

In the invention, the "powder" means an aggregate of fine crystal particles. In the invention, the "granule" means a granuled substance having a particle diameter of 50 to 5000 μm which is prepared by granulating a powder. In the invention, the "tablet" means one prepared by pressing a powder or granule to make a prescribed form.

Among the above-mentioned forms of the composition, the tablet is preferable because the tablet can be supplied with a high precision and can easily be handled.

For solidifying a photographic processing composition, an arbitrary method can be applied which includes a method in which a composition in a form of concentrated solution, powder or granule is kneaded with a water-soluble binder and shaped, and a method in which a processing composition is provisionally shaped and a water-soluble binder is sprayed on it to form a coating layer. Concerning such methods, JP O.P.I. Nos. 4-29136/1992, 4-85535/1992, 4-85536/1992, 4-85533/1992, 4-85534/1992 and 4-172341/1992 can be referred.

It is a preferable tableting method that in which a powder composition is granulated and the obtained granules are shaped into a tablet. A tablet prepared by the above-mentioned method has an advantage that the photographic properties of which is made more stable than those of a tablet prepared by simply tableting a powdered composition.

As a result of improvement in the dissolving property and storage ability, photographic properties are improved.

As the granulation method for making tablet, various known methods can be applied, which include a tumbling granulating method, an extruding granulation method, a compressing granulation method, crushing granulation method, stirring granulating method fluorized bed granulation method and spray drying granulation method. The average size of the granulated particles is preferably 100 to 800 μm, more preferably 200 to 750 μm, from the view point that a ununiformity or demixing of the composition is hardly formed at the time of mixing and compression of the granulated particles for tableting. The granulated particles preferably has a particle size distribution in which the 60% of the particles each have a particle size falling within the range of ±150 μm. For compressing the granulated particles, known compressing machines, such as an oil hydraulic pressing machine, single tableting machine, rotary tableting machine and briquetting machine, can be used. Although the solid processing composition prepared by compression can be take an optional shape, a cylindrical shape or tablet shape is preferable from the view point of producibility, handling property and dust formation on the user's side.

It is further preferable for enhancing the above-mentioned effects that an alkaline agent, reducing agent and preservative are each separately granulated.

The tableted processing composition can be produced by usual methods described in, for example, JP O.P.I. Nos. 51-61837/1976, 54-155038/1979 and 52-88025/1977, and British Patent (BP) No. 1,213,808. The granulated processing composition can be produced by usual methods described in, for example, JP O.P.I. Nos. 2-109042/1990, 2-109043/1990, 3-39735/1991 and 3-39739/1991. The powdered processing composition can be produced by usual methods described in, for example, JP O.P.I. No. 54-133332/1979, BP Nos. 725,892 and 729,862 and Germany Paten 3,733,861.

When the composition is in a shape of tablet, the bulk density of the above-mentioned solid processing composition is preferably 1.0 g/cm$^3$ to 2.5 g/cm$^3$ from the view point of the dissolving property thereof and the effects of the invention. A bulk density of not less than 1.0 g/cm$^3$ is preferable for a satisfactory mechanical strength and that not more than 2.5 g/cm$^3$ is preferable for an appropriate dissolving property of the tablet. When the processing composition is in a form of granule or powder, the bulk density is preferably 0.40 to 0.95 g/cm$^3$.

In the embodiment of the invention, although it is most preferable that all compositions to be used in the processing are each in a solid form, it is preferable that at least a developer composition is made to a solid form. The effects of the invention can be enhanced in the developer composition, because the developer contains various components which are chemically reactable with each other, and some of them are harmful. It is more preferable that a fixer composition is also solidified other than the developer.

A composition in which a part of the compositions is being made into a solid form can be used. However it is preferable that all processing compositions to be used in the processing in the invention are made to solid compositions. It is also preferable that the compositions are each separately shaped and packaged by the same number of tablets with respect to each compositions. It is further preferable that the components of the composition are made to separated solid compositions and the solid compositions are packaged in the supplying order of the molded components.

In the case of developer, it is a preferable embodiment of the invention that alkaline agent and reducing agent are all made into a solid composition. When the composition is tableted, it is preferable that the composition is made to three or less tablet, more preferably made to one tablet. When the composition is separately made to two or more kinds of tablet or granule, these tablet and granule are preferably packed in the same package.

It is preferable to directly supply the developer solid composition to the processing tank of an automatic processor according to the processed amount of the silver halide photographic light-sensitive material.

In the course of processing a silver halide photographic light-sensitive material, the developer and fixer are each replenished according to the information of processing amount of the light-sensitive material to prevent changing in the photographic properties of the processing solutions. The information of processing amount of light-sensitive material is a value proportional with the amount of light-sensitive material to be processed in the processing solution, the amount of light-sensitive material has been processed or the amount of the light-sensitive material in the course of processing, and the value directly or indirectly shows the reducing amount of processing agents in the processing solution. The amount of light-sensitive material may be detected at any of times such as a time before or after introducing the light-sensitive material to the processor or a time during the light-sensitive material is processed. The amount of light-sensitive material exposed in a printer is also applicable. Further, the concentration or its variation of a processing solution filled in the processing tank is applicable. The amount of light-sensitive material taken out from the processing machine after drying is also usable.

In the invention, it is preferable that the solid processing composition is directly supplied to the processing tank of the automatic processor according to the information of the processing amount of light-sensitive material. When replenishing water is necessary, water is supplied according to the information of processing amount or another water supply controlling information. In this case, the liquid to be supplied to the processing tank may be water only. By this way, the automatic processor can be made to compact because the number of tanks for replenishing water can be reduce to only one even when the number of tanks to be replenished is two or more. It is particularly preferable to install a tank of replenishing water at outside the automatic processor for making it to be compact.

In the invention, although the solid processing composition and/or replenishing water either can be supplied by the time at which a prescribed area of light-sensitive material has been processed, or according to the processing area of light-sensitive, it is preferable that the supplying is performed according to the processing amount of light-sensitive material detected by an area detective sensor provided in the processing machine.

In the invention, known methods described in Japanese Utility Model Publication Open to Public Inspection (JU O.P.I.) Nos. 63-137783/1988, 63-97522/1988 and 1-85732/1989 are usable as means for supplying a solid processing composition to the processing tank when the processing composition is in a form of tablet. However, any means can be used when they have at least a function to supply a tablet to the processing tank.

When the solid processing composition is in a form of granule or powder, methods using a screw or auger described in JU O.P.I. Nos. 62-81964/1987 and 63-84151/1988, JP O.P.I. No. 1-292375/1989, are usable. However, usable methods are not limited the above.

As a preferable method to supply a solid processing composition to a processing tank, a method is considered in which a package of a solid processing composition is opened to take out a prescribed amount of the solid processing composition according to the processing amount of light-sensitive material. In the package, packets of the previously weighed prescribed amount of the solid processing composition, are contained. In concrete, a prescribed amount, preferably an amount to be supplied for one time, of solid processing composition is contained in a package in which the solid processing composition is held between at least two parts of the package. The solid processing composition is brought into a condition being able to be taken out by cutting out a part of the package. The solid processing composition brought into a condition being able to be taken out can easily be supplied by falling to a processing tank having a filter means. Each of the prescribed amount of solid processing composition is separately held in the package sealed so that the air circulation between the solid processing composition and another solid processing composition held at an adjacent place or the open air is shut. Accordingly, the solid processing composition is protected from moisture until the package is opened.

In an embodiment of that, two parts of packaging material assembled so that the solid processing composition is placed between them, are separatably contacted or adhered at their touching surfaces. The solid processing composition is brought into a condition being able to be taken out by pulling the parts, the solid processing composition is placed between them, for different directions each other so that the contacted or adhered faces are separated.

In another embodiment, at least one of two parts of packaging material assembled so that the solid processing composition is placed between them, is made so as to bale to be open by a force added from the outside. "Open" means cutting off or breaking the packaging material remaining a part of it. As the opening method, a method in which a pressing force is give from the side of the packaging material to be not broken to the packaging material to be opened through the solid processing composition so as to pull out the solid processing composition, or a method in which the packaging material to be opened is cut off by a sharp cutting means so as to bring the solid processing composition into a condition being able to be taken out.

Although the solid processing composition is supplied to any portion of a processing Lank, it is preferable to supply it to a portion connected with a light-sensitive material portion processing portion so that a processing solution is circulated through that portion. It is further preferable that the portion has a structure so that a certain amount of the processing solution is circulated and dissolved composition is moved into the processing portion. The solid processing composition is preferably supplied in to a temperature controlled processing solution.

In general, the temperature of processing solution is controlled with an electric heater in an automatic processor. In the processor, an auxiliary tank, which is connected with a processing tank as the processing portion, is installed and a heat-exchanging means is provided in the replenishing tank having a heater. A motor is provided to circulate a prescribed amount of the processing solution through the replenishing tank for controlling the temperature of the processing solution.

A filter is generally provided to remove crystalline foreign substances which are mixed in or formed by crystallization.

It is most preferable method that the solid processing composition is supplied into a portion which is connected with the processing portion and thermally controlled such as the replenishing tank. When the solid processing composition is supplied into such portion, adhesion of a solid substance on the light-sensitive material can be prevented because an insoluble component of the solid processing composition is shut out from the processing portion by the filter portion.

When the processing composition supplying portion is provided in the processing tank together with a processing means, it is necessary consideration for providing a any means for preventing direct contact of the solid substance to the surface of film.

Any filter and filtering device having a quality usually applied to an ordinary automatic processor can be used in the invention. Effects of the invention is not influenced by any specific structure or material of the filtering device.

When a solid processing composition is directly supplied to a processing tank, a tank for storing a replenishing solution become to not necessary and the automatic processor can be made into compact. Further dissolving property of the solid processing composition is considerably improved when the processor has a means for circulation.

The circulation times of processing solution by the circulation means is preferably 0.5 to 2.0 cycles per minute, more preferably 0.8 to 2.0 cycles per minute, further preferably 1.0 to 2.0 cycles per minute. By such circulation, dissolving of the solid processing composition is accelerated and formation of a high concentration block in the processing solution is prevented. As results of that, a uniformity of image density in the processed light-sensitive material and an insufficient processing of light-sensitive material are also prevented.

It is preferable that the solid processing compositions relating the invention are each supplied to the processing tanks, respectively, separately to replenishing water. The replenishing water is preferably supplied from a replenishing water tank.

In the developing process in the invention, the developing temperature can either be set within an ordinary region of 20° to 30° C. or within a high temperature region of 30° C. to 40° C.

In the invention, it is preferable, for satisfying requirement to shorten developing time, that the total processing time from insertion of a film into the automatic processor to taking out the film from the drying zone of the processor, dry to dry, is within the range of 10 to 60 seconds. The "total processing time" includes all time necessary for processing a black-and-white light-sensitive material, for instance, the sum of the time of processes of developing, fixing, bleaching, washing, stabilizing and drying, in other word, the time for dry to dry. When the total processing time is less than 10 seconds, the sensitivity and contrast are lowered and satisfactory photographic properties are hardly obtained. The total processing time, dry to dry, of 15 to 50 seconds is more preferable.

The automatic processor includes one having a heat conductive device such as a heating roller heated at 90° C. to 130° C., or a heat irradiating device heated at not less than 150° C. in the drying zone thereof. The heat irradiating device includes one which is made from, for example, tungsten, carbon, nichrom, zirconium oxide, a mixture of yttrium oxide and thorium oxide or carbon silicate which is heated by electric current or one made from copper, stainless steel, nickel or various ceramics which is heated by heat conducted from a resistive heater. The heated device irradiates infrared radiation.

There is no specific limitation with respect to the halide composition of silver halide grains contained in a silver halide emulsion to be used in the invention. Preferable halide composition is silver chloride, silver chlorobromide containing not less than 60 mole % of silver chloride, silver iodochlorobromide containing not less than 60 mole % of silver chloride or silver iodobromide containing not more than 4 mole % of silver iodide.

The average grain size of silver halide is preferably not more than 1.2 μm, particularly 0.8 to 0.1 μm. The "average grain size" is an expression usually used in skilled one in the field of photographic science. The grain size means the diameter of grain when the shape of the grain is spherical or similar to spherical. When the grain has a cubic shape, the grain size is defined as the diameter of a sphere converted from the cube. As to the detail of the method for determining the average grain size, C. E. Mees & T. H. James, "The Theory of the Photographic Process" Third Edition p.p. 36–43, Macmillan, 1966, can be referred.

Concerning the shape of silver halide grain, tabular spherical, cubic, tetradecahedral and octahedral grain are also can be used without any limitation. A silver halide emulsion having a narrow grain size distribution is preferable and an emulsion so called a monodispersed emulsion is particularly preferable, in which 90%, more preferably 95%, of the whole silver halide grains have each a grain size falling within the range of ±40% or the average grain size of the emulsion.

In the invention, a single-jet mixing method, double-jet mixing method or a combination thereof may be used as the method for reacting a soluble silver salt and a soluble halide salt.

A reversal mixing method in which silver halide grains are formed in the presence of excess silver ions. As an embodiment of the double jet-mixing method, a controlled double-jet mixing method can be used. In this method, the pAg of the liquid phase in which silver halide grains are formed is maintained at a constant value. An emulsion comprising silver halide grains each having a regular shape and a size almost the same from each other can be obtained by such method.

It is preferable that a cadmium salt, zinc salt, lead salt, thallium salt, rhenium salt, iridium salt, rhodium salt or a complex salt containing one of these element is added to silver halide grains of the emulsion at a time of the step of forming or growing of the grains. As a ligand for forming the above complex, a nitrosyl ligand, thionitrosyl ligand, core ligand, cyanide ligand, halide ligand such as chloride ligand or bromide ligand is preferable.

The silver halide emulsion and preparation method thereof are described in detail in Research Disclosure No. 176, 17643, p.p. 22–23, December 1978 or publications cited therein.

The silver halide emulsion is preferably subjected to chemical sensitization. As the method of chemical sensitization, a sulfur sensitization, selenium sensitization, tellurium sensitization and noble metal sensitization are known and any of them may be used singly or in combination. As the sulfur sensitizer, well-known ones, preferably a sulfur sensitizer contained in gelatin, and various sulfur compounds such as thiosulfate, thioureas, rhodanines and polysulfides can be used. As selenium sensitizer, well-known selenium sensitizer, preferably for example, ones described in U.S. Pat. No. 1,623,499, JP O.P.I. Nos. 50-71325/1975 and 60-150046/1985, can be used.

As tellurium sensitizer, well-known tellurium sensitizer, preferably, for example, ones described in U.S. Pat. Nos. 1,623,499, 3,772,031 and 3,320,069, can be used.

Gold sensitizing method is a typical one of the noble metal sensitizing method, in which a gold compound, mainly a gold complex salt is used. A complex of noble metal complex other than gold such as complex of platinum, palladium or rhodium can also be used.

As the reducing sensitizer, stannous salts, amines, formamidinesulfinic acid and silane compounds can be used.

The silver halide emulsion can be spectrally sensitized for required wavelength by a sensitizing dye. Usable sensitizing dyes include cyanine dyes, merocyanine dyes, complex cyanine dyes, complex merocyanine dyes, holopolar cyanine dyes, hemicyanine dyes, styryl dyes and hemioxonol dyes. Any nuclei usually applied in cyanine dyes can be applied for these dyes as a basic heterocyclic nucleus. The nuclei include a nucleus of pyrroline, oxathiazoline, thiazoline, pyrrol, oxazole, thiazole, selenazole, imidazole, tetrazole and pyridine; the above nuclei each condensed with an aliphatic carbon hydride ring; and the above nuclei each condensed with an aromatic carbon hydride ring such as a nucleus of indolenine, benzoindolenine, indole, benzoxazole, naphthoxazole, benzothiazole, naphthothiazole, benzoselenazole, benzimidazole and quinoline. These nuclei each may have a substituent at the position of carbon atom thereon. Nuclei having a ketomethylene structure five- and six-member heterocyclic ring such as nucleus of pyrazoline-5-on, thiohydantoin, 2-2,4-dione, thiazolidine-2,4-dione, rhodanine and thiobarbituric acid, may be applied in the merocyanine dye or complex merocyanine dye. The dyes described in Research Disclosure, No. 76, RD-17643, p.p. 2–3, December 1978, and U.S. Pat. Nos. 4,425,425 and 4,425,426 may be used in concrete. The sensitizing dyes may be dissolved by means of ultrasonic vibration described in U.S. Pat. No. 3,485,634. Further, methods described in U.S. Pat. Nos. 3,482981, 3,585,194, 3,469,987, 3,425,835, 3,342,605, 3,660,101, and 3,658,546, British Patent Nos. 1,271329, 1,038,029 and 1,121,174 can be used for adding the sensitizing dye in the form of a solution or a dispersion to a silver halide emulsion. The above-mentioned dyes may be used either singly or in combination. A combination use of sensitizing dyes is used often for the purpose of super-sensitization. Combination of the dyes or substances showing an advantageous super-sensitizing effect are described in Research Disclosure No. 176, 17643, p. 23, Item IV-J, December 1978.

Various kinds of compounds may be contained in the light-sensitive material to be used in the invention for the purpose of prevention fogging during the production process, storage or photographic processing or the purpose of stabilization of photographic properties. The compounds include those known as an antifoggant or a stabilizer, for Example, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimiazoles, mercaptothiadiazoles, aminotriazoles, benzotriazoles, nitrobenztriazoles, mercaptotetrazoles particularly 1-phenyl-5-mercaptotetrazole, mercaptopyrimidines and mercaptotriazines; thioketo compounds such as oxazolinethion; azaindenes such as triazaindenes, tetrazaindenes, particularly 4-hydroxy-1,3,3a, 7-tetraza indenes, and pentazaindenes; benzenthiosulfonic acid and benzenesulfonamide.

An inorganic or organic hardener may be contained in the emulsion layer or a non-light-sensitive hydrophilic colloid layer of the light-sensitive material of the invention. The hardeners include chromium salts such as chromium alum and chromium acetate, aldehydes such as formaldehyde, glyoxal and glutaraldehyde, N-methylol compounds such as dimethylolurea and methyloldimethyl-hydantoine, dioxane derivatives such as 2,3-dihydroxy-dioxane, reactive vinyl compounds such as 1,3,5,triacryloyl-hexahydro-s-triazine, bis(vinylsulfonyl)-methylether and N,N'-methylene-bis[β-(vinylsulfonyl)-propanenamide], reactive halogen compounds such as 2,4-dichloro-6-hydroxy-s-triazine, mucohalogenic acids such as mucochloric acid and phenoxymucochloric acid, iso-oxazoles, dialdehyde starch, 2-chloro-6-hydroxy-triazinyl-gelatin, and carboxyl group active type hardeners. These hardeners can be used either singly or in combination. The hardeners are described in Research Disclosure No. 176, 17643, p. 23, Items A–C, December 1978. Among the above hardeners, carboxyl group active type hardeners are preferable, which include carbamoylammonium type hardeners described in JP Nos. 56-12853/1981, 58-32699/1983, JP O.P.I. Nos. 49-51945/1874, 61-9641/1986, 1-270046/1989 and those represented by formula (a) described in 63-61254/1988; hardeners described in Belgium Patent No. 825,726; amidinium type hardeners described in JP O.P.I. Nos. 60-225148/1985 and 61-240236/1986; carbodiimide type hardeners described in 51-126125/1976 and 52-48311/1977; pyridinium salt type hardeners described in JP O.P.I. Nos. 58-50699/1983, 57-44140/1982, 57-46538/1982 and 52-54427/1977; and hardeners represented by Formula (b) described in JP O.P.I. No. 63-61254/1988. Among the above, carbamoylammonium type hardeners represented by Formula (I) described in JP O.P.I. No. 1-270046 are more preferable.

Various kinds of surfactants can be used in the emulsion layer and/or the non-light-sensitive material of the invention for various purposes such as coating aid, antistatic, for improvement of slipping property, dispersing aid, for adhesion prevention and improvement of photographic properties.

Although gelatin is advantageously used as a binder or protective colloid, another hydrophilic colloid can also be used. Various kinds of synthetic hydrophilic macromolecular substances can be used, for example, gelatin derivatives; graft polymers of gelatin and another polymer; proteins such as albumin and casein; cellulose derivatives such as hydroxyethyl cellulose, carboxymethyl cellulose and cellulose sulfates; sugar derivatives such as sodium arginate and starch derivatives; homo- or co-polymers such as polyvinyl alcohol, partially acetalized polyvinyl alcohol, polyvinyl-N-pyrrolidone, polyacrylic acid, polymethacrylic acid, polyacrylamide and polyvinylpyrazole.

As gelatin, acid processed gelatin, a hydrolysis product of gelatin and a enzym decomposed product of gelatin can also be used other than lime processed gelatin. The amount of gelatin to be coated on the support of the invention is preferably 1.0 to 3.5 g/m$^2$ more preferably 1.8 to 3.0 g/m$^2$.

In the silver halide photographic light-sensitive material usable in the invention, a dispersion of water-insoluble or slightly soluble synthetic polymer may be contained for the purpose of improvement in dimension stability. Usable polymers include those derived from alkyl (metha)acrylate, alkoxyalkyl (metha)acrylate, glycidyl (metha)acrylate, (metha)acrylamide, a vinyl ester such as vinyl acetate, acrylonitryle, olefin or styrene, or combination thereof, and copolymers derived from the above-mentioned monomer and acrylic acid, methacrylic acid, α,β-unsaturated dicarboxylic acid, hydroxyalkyl (metha)acrylate, sulfoalkyl (metha)acrylate or styrene-sulfonic acid.

In the light-sensitive material relating the invention, particularly in a light-sensitive material for graphic arts, a hydrazine compound represented by the following Formula [H] or a tetrazolium compound preferably contained for the purpose to obtain a high contrast.

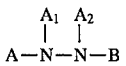

Formula H wherein A is an aliphatic group, an aromatic group or a heterocyclic group; B is an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, an oxalyl group, or a heterocyclic group; $A_1$ and $A_2$ are each independently a hydrogen atom, an acyl group, a sulfonyl group, or an oxalyl group, provided that at least on of them is a hydrogen atom; and $A_2$ and Band a nitrogen atom liked with them may be form a partial structure of hydrazone —N=C<.

In Formula H, the aliphatic group represented by A is a straight-chain, branched-chain or cyclic alkyl group having 1 to 30, preferably 1 to 20 carbon atoms such as a methyl group, ethyl group, t-butyl group, octyl group, cyclohexyl group or benzyl group. The aliphatic group may have an appropriate substituent such as an aryl group, alkoxy group, aryloxy group, alkylthio group, a sulfoxy group, aulfonamido group, acylamino group, or ureido group.

In Formula H, an aromatic group represented by A is preferably an aryl group having a single ring or a condensed ring such as a benzene ring or naphthalene ring.

In Formula H, a heterocyclic group represented by A is preferably a heterocyclic group having a single ring or condensed ring and containing at least one of a nitrogen atom, sulfur atom or oxygen atom. Examples of the heterocyclic group are, for example, a pyrrolidine ring, imidazole ring, tetrahydrofurane ring, morpholine ring, pyridine ring, pyrimidine ring, quinoline ring, thiazole ring, benzothiazole ring, thiophene ring and furane ring.

An aryl group and a heterocyclic group are particularly preferable as a group represented by A.

The aryl group or heterocyclic group represented by A each may have a substituent. As typical examples of the substituent include, for example, an alkyl group preferably having 1 to 20 carbon atoms, an aralkyl group preferably one composed of a single or condensed ring and a moiety of alkyl having 1 to 3 carbon atoms, an alkoxy group preferably having 1 to 20 carbon atoms, a substituted amino group preferably a amino group substituted with an alkyl group having 1 to 20 carbon atoms or an alkylidene group, an acyl group preferably having 1 to 40 carbon atoms, a sulfonamido group preferably having 1 to 40 carbon atoms, a ureido group preferably having 1 to 40 carbon atoms, a hydrazinocarbonylamino group preferably having 1 to 40 carbon atoms, a hydroxyl group, a phosphonamido group preferably having 1 to 40 carbon atoms.

Concrete groups represented by B are, for example, an acyl group such as a formyl group, acetyl group, propionyl group, trifluoroacetyl group, methoxyacetyl group, phenoxyacetyl group, methythioacetyl group, chloroacetyl group, benzoyl group, 2-hydroxymethylbenzoyl group or 4-chlorobenzoyl group, an alkylsulfonyl group such as a methanesulfonyl group or 2-chlorethanesulfonyl group, an arylsulfonyl group such as a benzensulfonyl group, an alkylsufinyl group such as a methanesulfinyl group, an arylsulfinyl group such as a benzenesulfinyl group, a carbamoyl group such as a methylcarbamoyl group or phenylcarbamoyl group, an alkoxycarbonyl group such as methoxycarbonyl group of ethoxycarbonyl group, an arylcarbonyl group such as a phenoxycarbonyl group, a sulfamoyl group such as a dimethylsulfamoyl group, a sulfinamoyl group such as a methylsulfinamoyl group, an alkoxysulfonyl group such as a methoxysulfonyl group, a thioacyl group such as a methylthiocarbonyl group, an oxalyl group such as one later-mentioned, and a heterocyclic group such as a pyridine ring or pyridinium ring.

In Formula H, B may be linked with $A_2$ and a nitrogen atom linked with them to form a

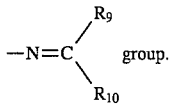

In the above, $R_9$ is an alkyl group, an aryl group or a heterocyclic group; and $R_{10}$ is a hydrogen atom, an alkyl group, an aryl group or a heterocyclic group.

Preferable group representedby B is an acyl group or an oxalyl group.

$A_1$ and $A_2$ are each a hydrogen atom, an acyl group such as an acetyl group, trifluoroacetyl group or benzoyl group, a sulfonyl group such as a methane sulfonyl group or toluenesulfonyl group, or an oxalyl group. At least one of $A_1$ and $A_2$ is a hydrogen atom.

Among hydrazine compound usable in the light-sensitive material relating to the invention, a compound represented by the following Formula H-a is preferable.

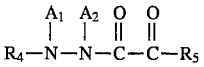

Formula H-a wherein $R_4$ is an aryl group or a heterocyclic group; $R_5$ is an

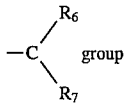

or —$OR_8$ group, $R_6$ and $R_7$ are each a hydrogen atom, an alkyl group, an alkenyl group, an alkynyl group, an aryl group, a heterocyclic group, an amino group, a hydroxyl group, an alkoxy group, an alkenyloxy group, an alkynyloxy group, an aryloxy group, or a heterocyclic-oxy group; $R_8$ a hydrogen atom, an alkyl group, an alkenyl group, an alkynyl group, an aryl group, of a heterocyclic group. $A_1$ and $A_2$ are each synonymous with $A_1$ and $A_2$ in Formula H, respectively.

Formula H-a is described in detail below.

As the aryl group represented by $R_4$, one having a single ring and a condensed ring such as a phenyl ring or naphthalene ring are preferable.

As the heterocyclic group represented by $R_4$, a 5- or 6-member unsaturated single heterocyclic group containing at least one hetero-atom selected from a nitrogen atom oxygen atom and sulfur atom and a condensed heterocyclic group in which the above-mentioned heterocyclic ring is condensed with another ring, are preferable. The examples of the preferable heterocyclic group include a pyridine ring, quinoline ring, pyrimidine ring, thiophene ring, furane ring thiazole ring and benzothiazole ring.

As the group representedby $R_4$, an aryl group is preferable and a benzene ring is most preferable.

Although $A_1$ and $A_2$ are each synonymous with $A_1$ and $A_2$ in Formula H, it is most preferable that both of $A_1$ and $A_2$ are hydrogen atoms.

R-5 represents an

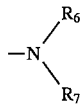

or an —$OR_8$ group, in which $R_6$ and $R_7$ are each a hydrogen atom, an alkyl group such as a methyl group, ethyl group or benzyl group, an alkenyl group such as an ally group or butenyl group, an aryl group such as a phenyl group or naphthyl group, a heterocyclic group such as a heterocyclic group such as a 2,2,6,6-tetramethylpiperidinyl group, N-benzylpiperidinyl group, quinuqulidinyl group, N,N-diethylpyrazolidinyl group, N-benzylpyrrolidinyl group or pyridinyl group, an amino group such as an amino group, methylamino group or dibenzylamino group, an hydroxyl group, an alkoxy group such as a methoxy group or ethoxy group, an alkenyloxy group such as an allyloxy group, an alkynyloxy group such as propalgyloxy group, aryloxy group such as a phenoxy group, or a heterocyclic-oxy group such as a pyridinyloxy group. $R_6$ and $R_7$ may be linked together with the nitrogen atom to form a ring such as a piperidine ring or morpholine ring. $R_8$ is a hydrogen atom, an alkyl group such as a methyl group, ethyl group, methoxyethyl group or hydroxyethyl group, an alkenyl group such as an allyl group or butenyl group, an alkynyl group such as propalgyl group or butynyl group, an aryl group such as a phenyl group of naphthyl group, or a heterocyclic group such as a 2,2,6,6-tetramethylpiperidinyl group, N-methylpiperidinyl group or pyridyl group.

Example of the compound represented by Formula H are described below.

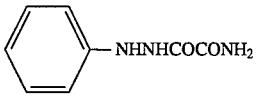

H-1

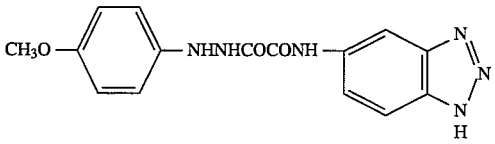

H-2

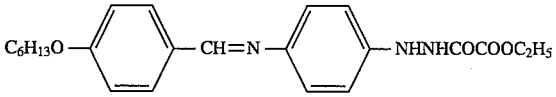

H-3

-continued
H-4
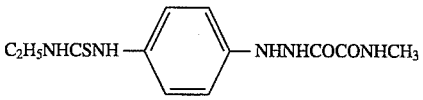
H-5
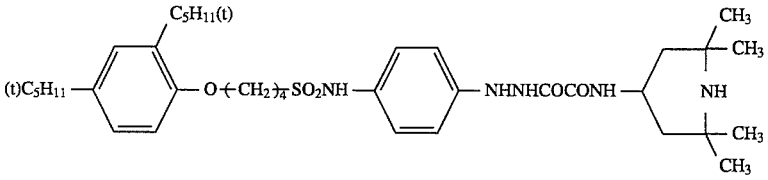
H-6
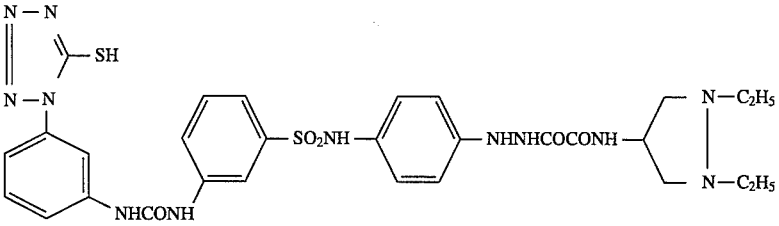
H-7
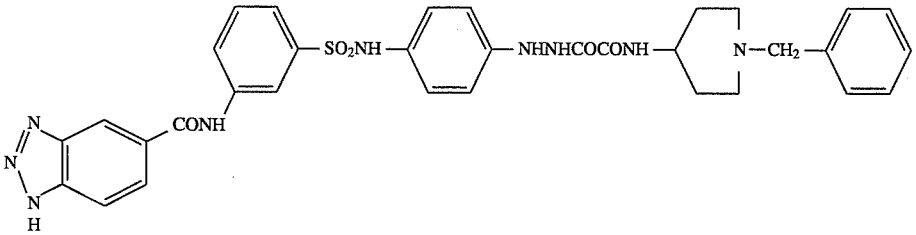
H-8
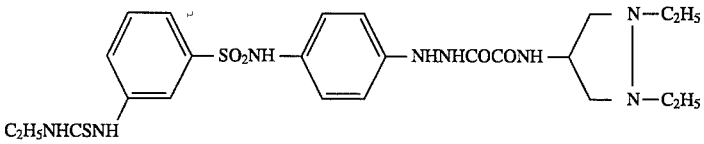
H-9
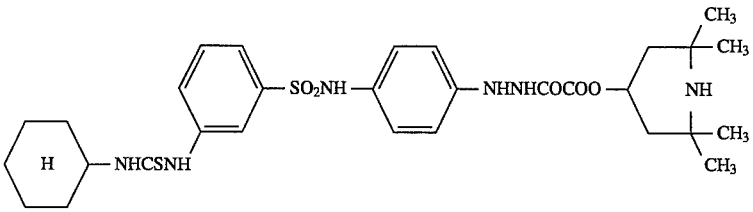
H-10
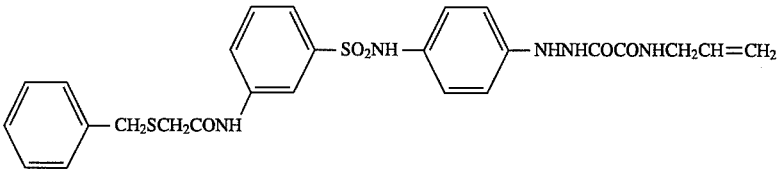
H-11
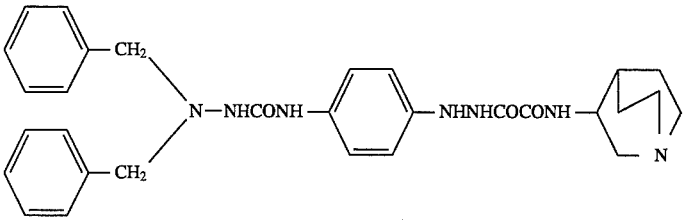

-continued
H-12
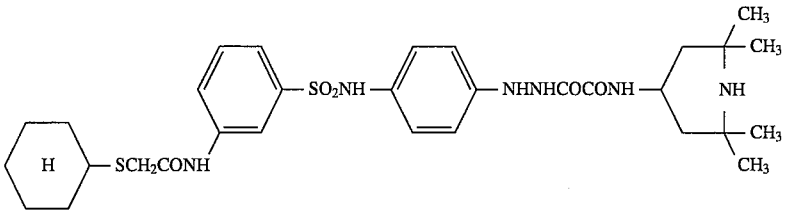
H-13
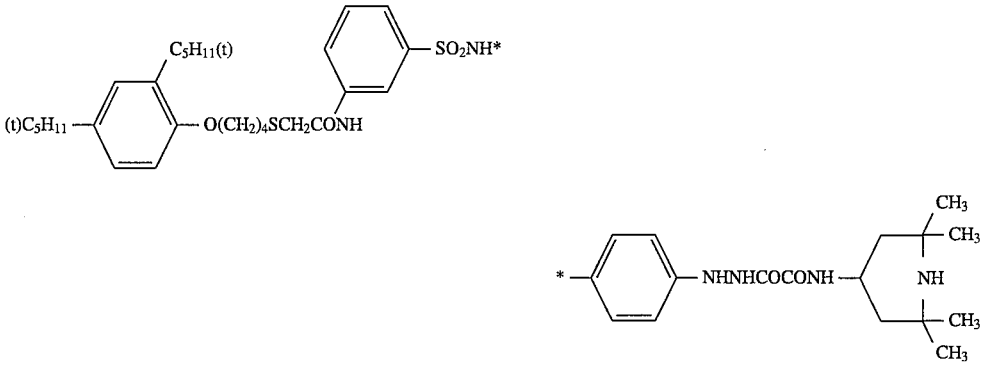
H-14
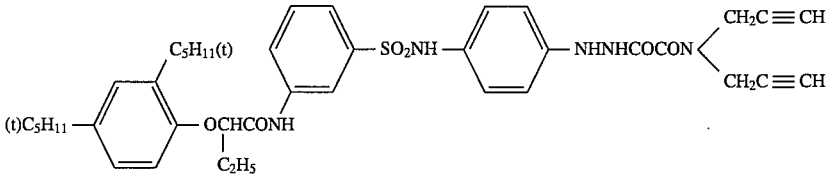
H-15
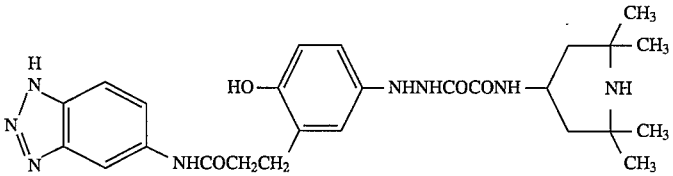
H-16
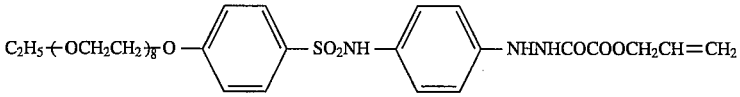
H-17
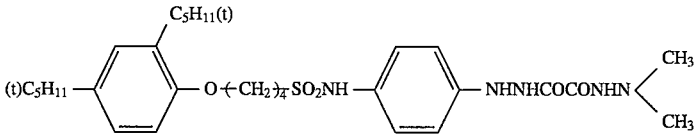
H-18
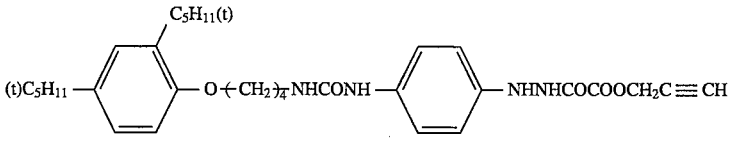
H-19
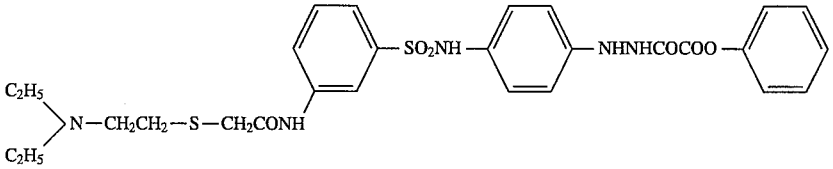
H-20
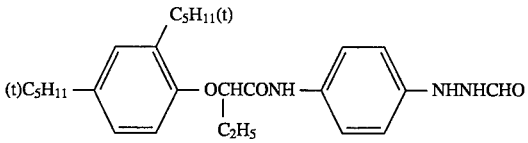

-continued
H-21
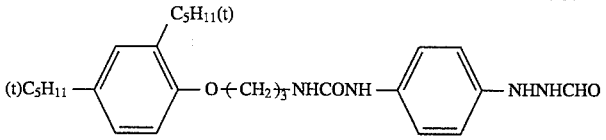
H-22
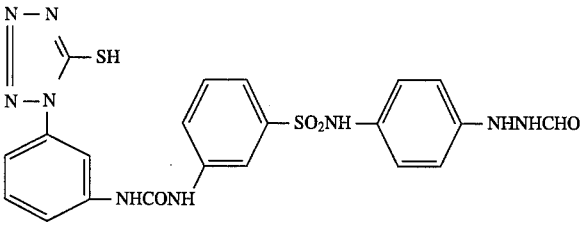
H-23
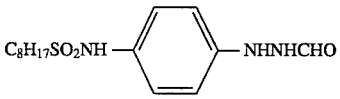
H-24
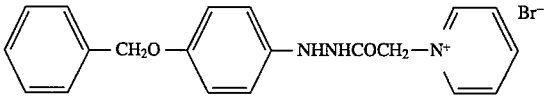
H-25
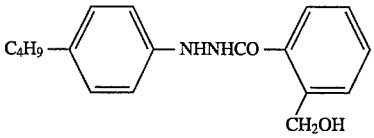
H-26
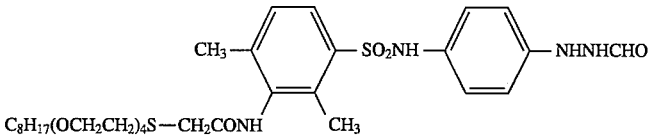
H-27
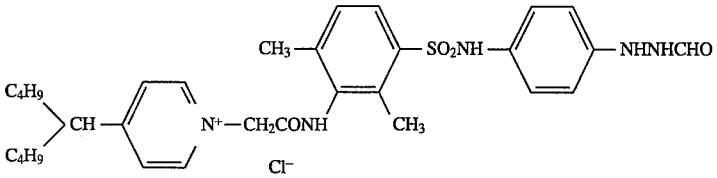
H-28
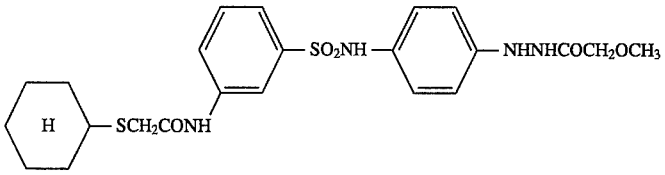
H-29
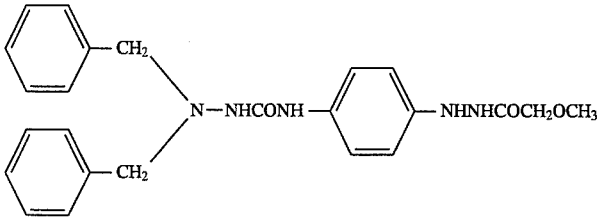
H-30
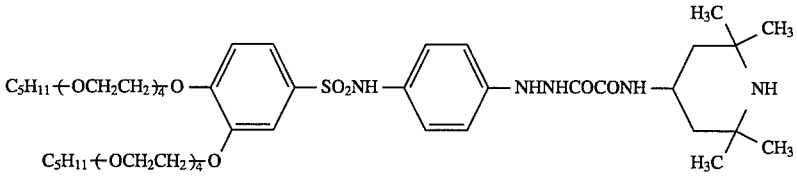

-continued
H-31
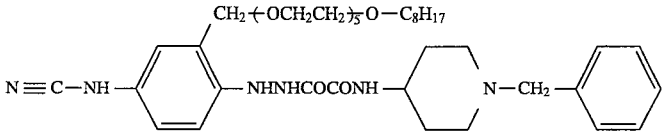
H-32
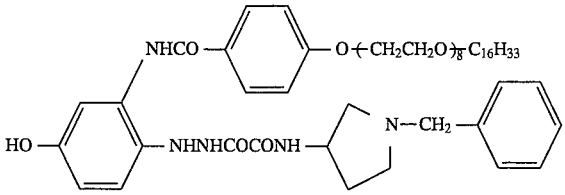
H-33
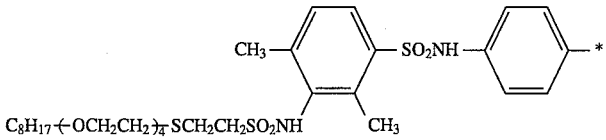
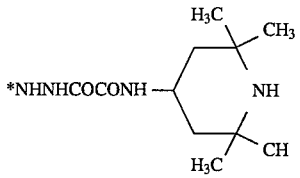
H-34
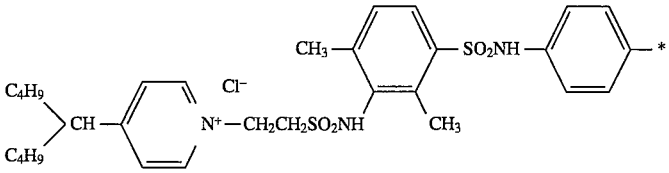
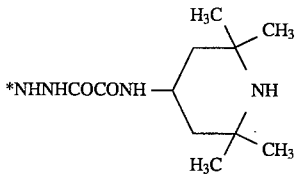
H-35
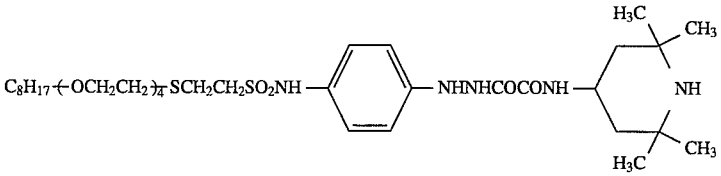
H-36
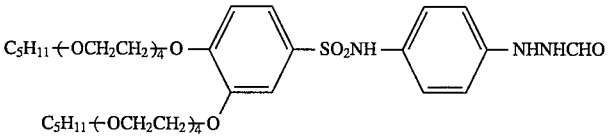
H-37
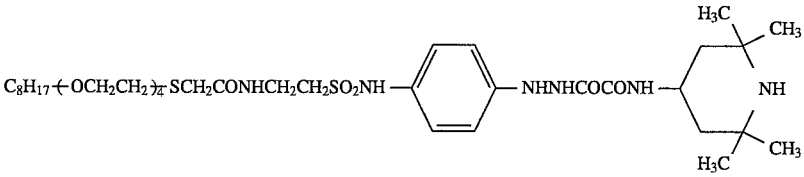

-continued

H-38

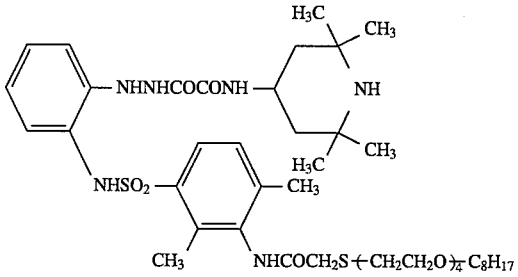

H-39

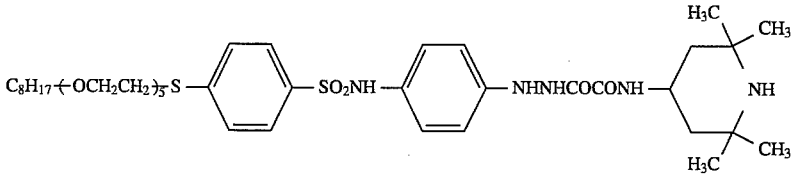

H-40

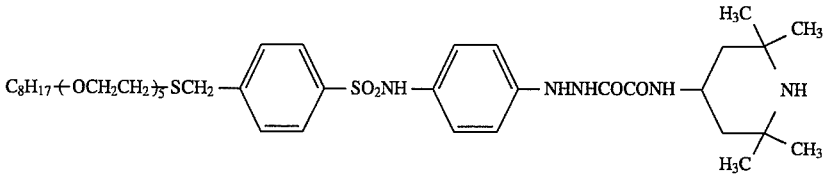

The compounds represented by Formula H can be synthesized referring synthesis method described in JP O.P.I. Nos. 62-180361/1987, 62-178246/1987, 63-234245/1987, 63-234246/1987, 64-90439/1988, 2-37/1990, 2-841/1990, 2-947/1990, 2-120736/1990, 2-230233/1990 and 3-125134/1991, U.S. Pat. Nos. 4,686,167, 4,998,604 and 4,994,365, and European Paten Nos. 253,665 and 333,435.

The amount of the compound represented by Formula H to be contained in the light-sensitive material is preferably $5\times10^{-7}$ to $5\times10^{-7}$ moles, particularly $5\times10^{-6}$ to $5\times10^{-2}$ moles, per mole of silver halide.

When the compound represented by Formula H is added to the light-sensitive material, the compound is added in silver halide emulsion layer or a hydrophilic colloid layer adjacent to the emulsion layer.

As the tetrazolium compound, a compound represented by the following Formula T is preferable.

Formula T

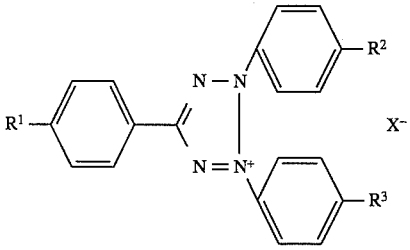

wherein are each independently a hydrogen atom or a group having a negative $\sigma_p$ value of Hammett; and $X^-$ is an anion.

It is essential that the substituent represented by $R^1$, $R^2$ and $R^3$ is a group having a negative $\sigma_p$ value of Hammett indicating an electron withdrawing ability, or an electron withdrawing group.

The $\sigma$ value of Hammett in a substituent of phenyl group can be found in various publications, for example, Journal of Medical Chemistry, Vol. 20, p. 304, 1977, C. Hansch. As groups having a negative $\sigma_p$ value, for example, a methyl group ($\sigma_p$=−0.17), ethyl group ($\sigma_p$=−0.15), cyclopropyl group ($\sigma_p$=−0.21), n-propyl group ($\sigma_p$=−0.13), iso-propyl group ($\sigma_p$=−0.15), cyclobutyl group ($\sigma_p$=−0.15), n-butyl group ($\sigma_p$=−0.16), iso-butyl group ($\sigma_p$=−0.20), n-pentyl group ($\sigma_p$=0.15), cyclohexyl group ($\sigma_p$=−0.22), an amino group ($\sigma_p$=−0.66), acetylamino group ($\sigma_p$=−0.15), hydroxyl group ($\sigma_p$=−0.37), methoxy group ($\sigma_p$=−0.27), ethoxy group ($\sigma_p$=−0.24), propoxy group ($\sigma_p$=−0.25), butoxy group ($\sigma_p$=−0.32) and pentoxy group ($\sigma_p$=−0.17) are cited. The above groups are effective as the substituents in the compound represented by Formula T.

Examples of the compound represented by Formula T, T-1 to T-18 are described below.

T-1

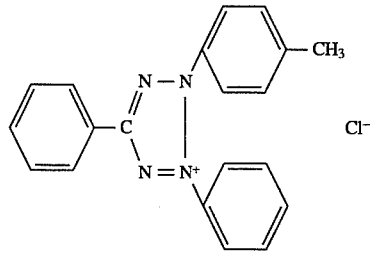

T-2

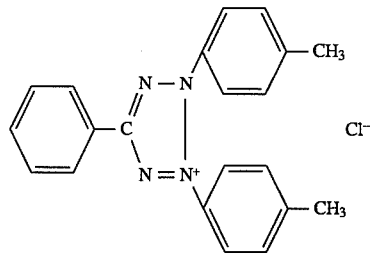

-continued
T-3
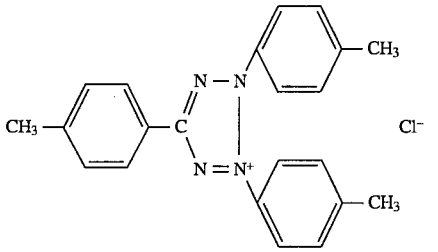
T-4
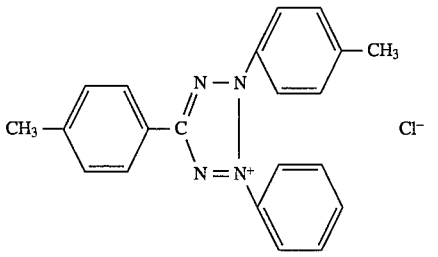
T-5
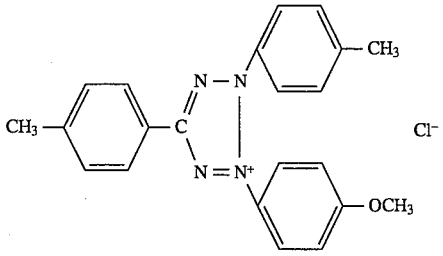
T-6
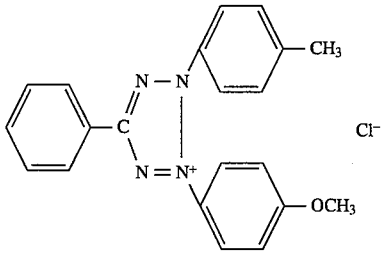
T-7
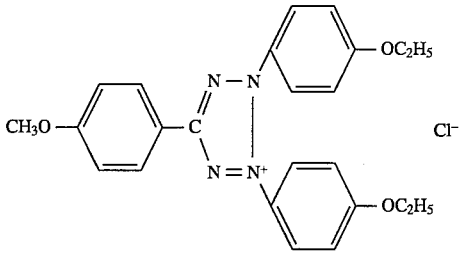
T-8
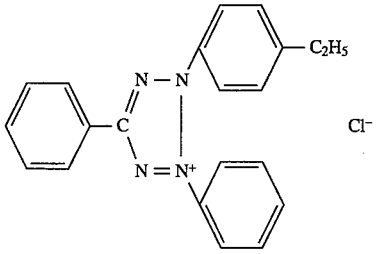
-continued
T-9
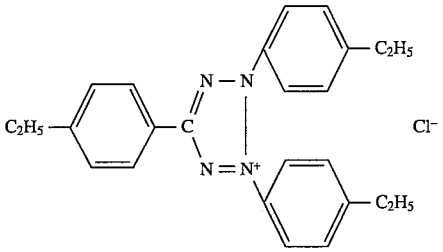
T-10
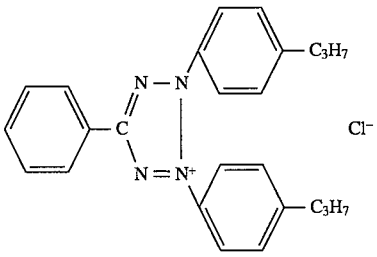
T-11
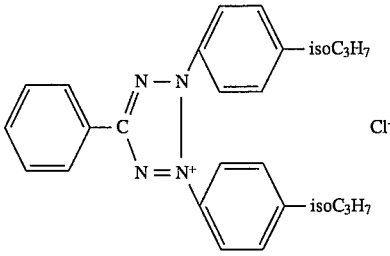
T-12
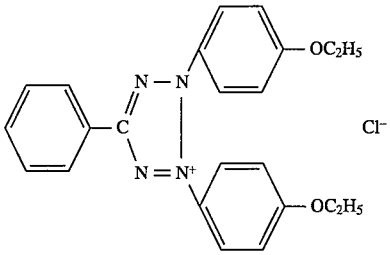
T-13
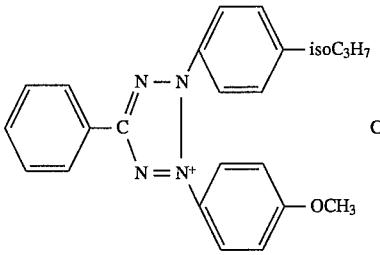
T-14
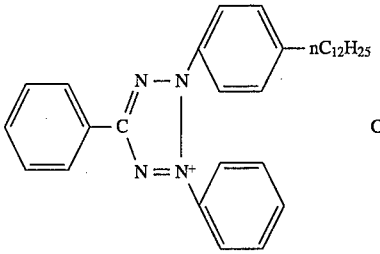

-continued

T-15

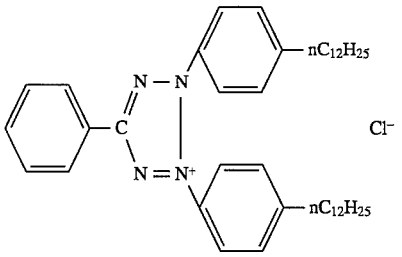

T-16

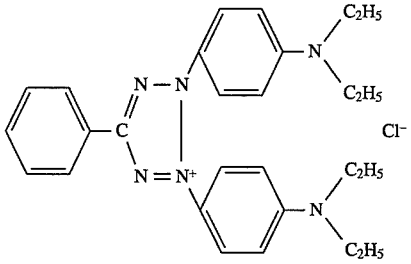

T-17

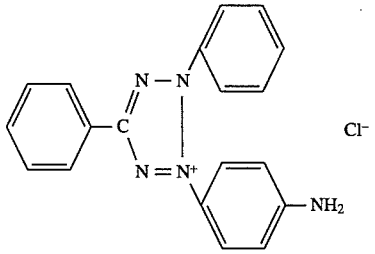

T-18

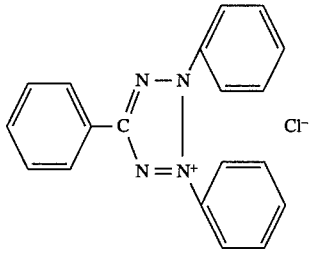

The compounds represented by Formula T can be easily synthesized, for example, by the method described in Chemical Review Vol. 55, p.p. 335–483.

The amount of the compound represented by Formula T to be contained in the light-sensitive material is preferably 1 mg to 10 g, particularly 10 mg to 2 g, per mole of silver halide contained in the light-sensitive material.

When the hydrazine compound is used in the light-sensitive material, it is preferable to add a nucleation accelerating agent selected from amino compounds, quartenary onium compounds and alcohol compounds to a silver halide emulsion layer or a non-light-sensitive hydrophilic colloid layer provided on the emulsion layer coated side of the light-sensitive material. As the amine compound primary, secondary or tertiary amine compounds may be used. Among them, an amine compound having not less than 8 carbon atoms is preferably used. As the quartenary onium compounds, compounds having a quartenary nitrogen atom or a quartenary phosphor atom are preferable. Preferable alcohol compounds are ones having not less than 8 carbon atoms.

As the nucleation accelerating agent, compounds represented by the following Formula B-1 or B-2 are cited.

Formula B-1

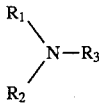

Formula B-2

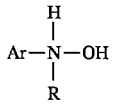

In Formula B-1, $R_1$, $R_2$ and $R_3$ are each independently a hydrogen atom, an alkyl group, an alkenyl group, an alkynyl group, an aryl group, the above alkyl group, alkenyl group and aryl group each may have a substituent. $R_1$, $R_2$ and $R_3$ may be linked to form a ring. Particularly preferable compound is an aliphatic tertiary amine compound. These compounds preferably each have anti-diffusion group or a silver halide adsorption group. For having an anti-diffusion property, the molecular weight of the compound is preferably not less than 100, more preferably 300 or more. The preferable silver halide adsorption group includes a nitrogen-containing heterocyclic group, a mercapto group, a thioether group, a thione group and a thiourea group.

Preferable substituent of alkyl group, alkenyl group and aryl group represented by $R_1$, $R_2$ and $R_3$ of Formula B-1 are, for example, a halogen atom such s a chlorine atom or bromine atom, a hydroxyl group, an aryl group having 6 to 20 carbon atoms such as a phenyl group or naphthyl group, an alkyl group having 1 to 20 carbon atoms such as a methyl group, ethyl group, butyl group, cyclohexyl group, isopropyl group or dodecyl group, a heterocyclic group such as a 2,2,6,6-tetramethylpiperidyl group, quinolidinyl group, N,N'-diethylpyrazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyl group having 1 to 20 carbon atoms such as a propagyloxy group, a heterocyclic-oxy group such as pyridinyloxy group, an acylamino group having 1 to 26 carbon atoms such as an acetylamino group, heptanoylamino group or propionylamino group, or an amino group such as an amino group, methylamino group, dimethylamino group or benzylamino group.

Exemplified compounds of Formula B-1 are described below.

B-1-1

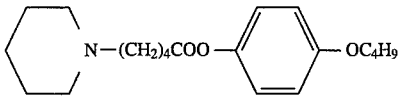

B-1-2

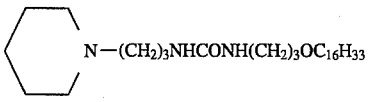

B-1-3

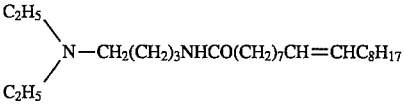

B-1-4

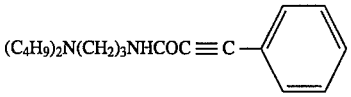

-continued

B-1-5

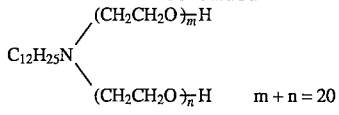

m + n = 20

B-1-6

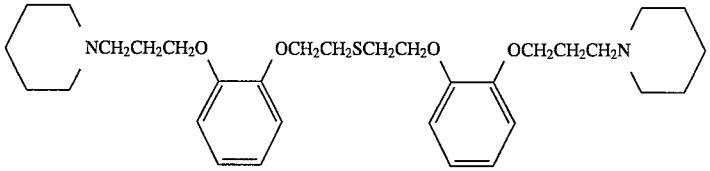

B-1-7

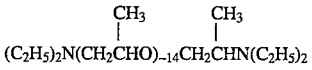

B-1-8

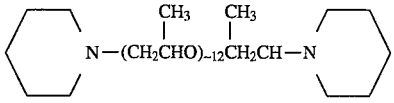

B-1-9

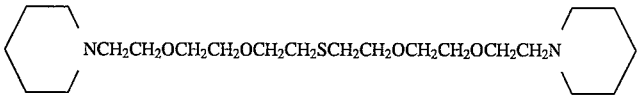

B-1-10

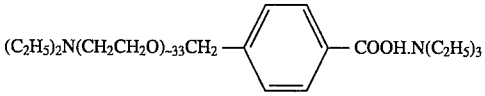

B-1-11

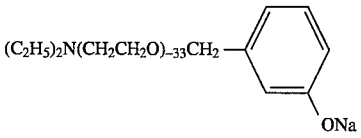

B-1-12

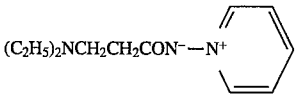

B-1-13

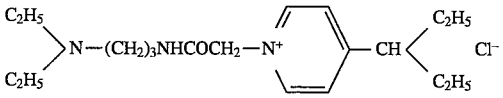

B-1-14

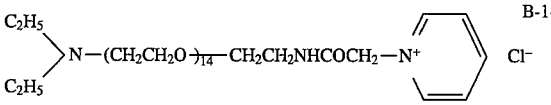

B-1-15

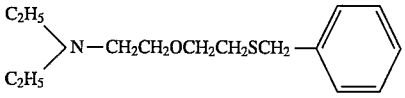

B-1-16

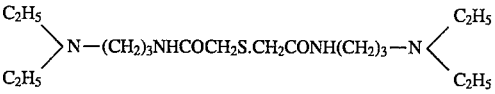

B-1-17

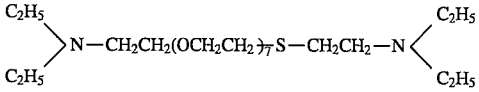

B-1-18

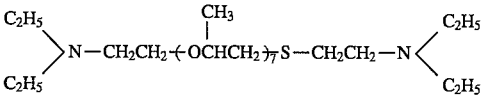

B-1-19

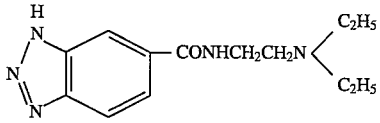

B-1-20

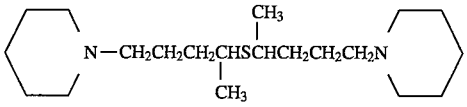

In Formula B-2, Ar is an alkyl group which may have a substituent, or an aromatic heterocyclic group. R is an alkyl group, an alkenyl group, an alkynyl group or an aryl group, each of them may have a substituent. These compounds preferably each have anti-diffusion group or a silver halide adsorption group. For having an anti-diffusion property, the molecular weight of the compound is preferably not less than 120, more preferably 300 or more.

Exemplified compounds of Formula B-2 are described below.

B-2-1

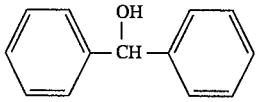

B-2-2

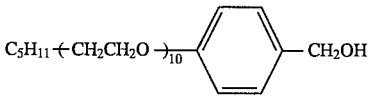

-continued

B-2-3

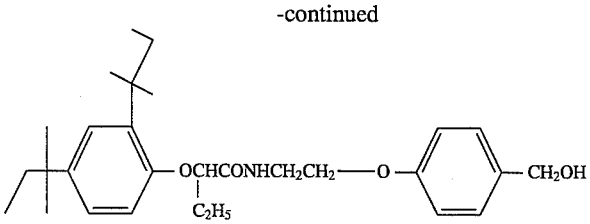

B-2-4

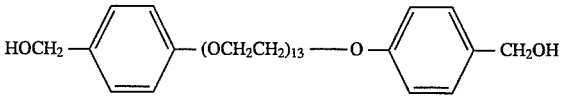

B-2-5

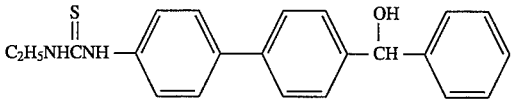

B-2-6

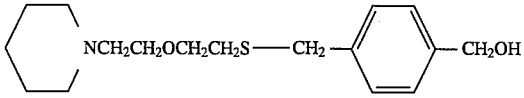

The light-sensitive material usable in the invention preferably contains a dye having a adsorption maximum within the wavelength range of 300 nm to 900 nm in any one layer thereof for the purpose of antihalation, improvement in safelight properties, gradation control, cross-over cutting property improvement and sharpness improvement. For such dye, those represented by Formulas (I) to (VII) described at paragraph No. 0010 to No. 0037 of JP O.P.I. No. 6-222503 are preferable, which are added in a form of solid and the influence of them on the sensitivity and gradation of the light-sensitive material is small. Concrete examples of such dyes are I-1 through VIII-2 described at paragraph No. 0029 to No. 0035 of JP O.P.I. No. 6-222503 and the exemplified compound described on pages 8 to 16 of JP O.P.I. No. 4-14038/1992. These dyes are preferably added in the emulsion layer and/or a layer adjacent to the emulsion layer or in a layer provided on the surface of the support opposite to the emulsion coated surface. For enhancing the effect of antihalation, the dye is preferably added in a layer arranged between the support and the emulsion layer or in the layer provided on the surface opposite to the emulsion coated surface. For enhancing the safelight property improvement effect, the dye is preferably added in a layer provided on the emulsion layer.

To the light-sensitive material usable in the invention, various kinds of additives can be added such as a desensitizing agent, a plasticizer, a lubricant, development accelerating agent and an oil.

The above-mentioned and other known addenda are described in Research Disclosures (RD) No. 17643, December 1978, No. 18716, November 1979, and No. 308119, December 1989. The kinds of the compounds and the described portion of them in above three volumes of Research Disclosure as follows.

| | RD-17643 | | RD-18716 | | RD-308119 | |
|---|---|---|---|---|---|---|
| Addenda | Page | Item | Page | Item | Page | Item |
| Chemical sensitizer | 23 | III | 648 R(u) | | 996 | III |
| Sensitizing dye | 23 | IV | 648–649 | | 996–8 | IV |
| Desensitizing dye | 23 | IV | | | 998 | B |

-continued

| | RD-17643 | | RD-18716 | | RD-308119 | |
|---|---|---|---|---|---|---|
| Addenda | Page | Item | Page | Item | Page | Item |
| Dye | 25–26 | VIII | 649–650 | | 1003 | VIII |
| Developing Accelerator | 29 | XXI | 648 R(u) | | | |
| Antifoggant, stabilizer | 24 | IV | 649 R(u) | | 1006–7 | VI |
| Whitening agent | 24 | V | | | 998 | V |
| Hardener | 26 | X | 651 L | | 1004–5 | X |
| Surfactant | 26–7 | XI | 650 R | | 1005–6 | XI |
| Antistaic agent | 27 | XII | 650 R | | 1006–7 | XIII |
| Plasticizer | 27 | XII | 650 R | | 1006 | XII |
| Rublicant | 27 | XII | | | | |
| Matting agent | 28 | XVI | 650 R | | 1008–9 | XVI |
| Binder | 26 | XXII | | | 1003–4 | IX |
| Support | 28 | XVII | | | 1009 | XVII |

(R: Right column R(u): Upper portion of right column L: Left column)

In the light-sensitive material of the invention, a crossover cutting layer, an antihalation layer or a back-coat layer may be provided.

The emulsion layer may be either provided on both sides or one side of the support. In the case that the emulsion layers are provided on both sides of the support, the properties of the emulsion layers may be the same or different.

EXAMPLES

The present invention will be described in detail below according to examples. However the embodiment of the invention is not limited to the examples.

Example

Preparation or Support

Synthesize of SPS

In 200 g of toluene, 100 g of styrene, 56 g of triisobutyl aluminum and 234 g of trio-iso-pentamethylcyclopentadienyltitanium trimethoxide were reacted at 96° C. for 8 hours. Then the catalyst was removed with a methanol solution of sodium hydroxide, after that, the remained matter was washed by methanol for 3 times. Thus 34 parts by weight of objective substance was obtained.

Preparation of SPS Film

The above-obtained SPS was extruded through a T-dye and rapidly cooled and solidified on a cooling drum to form a unstretched film. At this time, the taking up speed of the cooling drum is controlled for two steps. Thus unstretched films each having a thickness of 1370 μm and 1054 μm were prepared. These films were preheated at 135° C. and stretched by 3.1 times for longitudinal direction and stretched by 3.4 times for traverse direction at 130° C., and is thermally fixed at 250° C. Thus supports having a bending elasticity of 450 kg/mm$^2$ were prepared. The thickness of the supports were 130 μm and 100 μm, respectively. The bending elasticity of a polyethylene-terephthalate (PET) used as a comparative sample was 460 kg/mm$^2$.

Subbing Layer Coating on SPS Film

A latex subbing solution containing a latex for subbing (solid content was 20%) was coated on the above obtained SPS film and the comparative PET film so that the thickness after drying to be 0.5 μm and dried at 120° C. for one minute. The surfaces of the films were treated with corona discharge of 0.5 KV·A·min/m$^2$.

Silica was spattered and four kinds of adhesive layer of 0.3 μm each composed of vinylidene chloride, styrene-butadiene, styrene-glycidyl acrylate or gelatin, respectively were formed on the surfaces of the supports.

Example 1

Propitiation of Silver Halide Emulsion A

Silver chlorobromide core grains were prepared by a double-jet mixing method, which were composed of 70 mole % of silver chloride and remaining part of silver bromide, and have an average thickness of 0.05 μm and an average diameter of 0.15 μm. To the core grains, $8\times10^{-8}$ moles per mole of silver of $K_3RuCl_6$ was added during the mixing process. On each of the core grains, a shell was formed by a double-jet mixing method. During the shell formation, $3\times10^{-7}$ mole per mole of silver of $K_2IrCl_6$ was added. Thus obtained emulsion was a core/shell type monodisperse silver chloroiodobromide emulsion having an average thickness of 0.10 μm, an average diameter of 0.25 μm and a grain size variation coefficient of 10%. The grains were composed of 90 mole % of silver chloride, 0.2 mole % of silver iodide and the remaining part of silver bromide. Then the emulsion was desalted by making use of a modified gelatin described in JP O.P.I. No. 2-280139 which is a gelatin modified by substituting an amino group of gelatin with phenylcarbamoyl such as Compound G-8 exemplified on page 287(3) of the above Japanese patent publication. The value of $E_{Ag}$ of the desalted emulsion was 190 mV at 50° C.

To thus obtained emulsion, $1\times10^{-3}$ moles per mole silver of 4-hydroxy-6-methyl-1,3,3a,7-tetrazaindene was added. Further, potassium bromide and citric acid were added to the emulsion to adjust the values of pH and $E_{Ag}$ were adjusted to 5.6 and 123 mV, respectively. Then $2\times10^{-5}$ moles of auric chloride and $3\times10^{-6}$ moles of elemental sulfur were added to the emulsion. The emulsion was chemically ripened at 60° C. so as to attain to the maximum sensitivity of the emulsion. After completion of the ripening, $2\times10^{-3}$ moles per mole silver of 4-hydroxy-6-methyl-1,3,3a-tetrazaindene, $3\times10^{-4}$ moles per mole of silver of 1-phenyl-5-mercaptotetrazole and gelatin were added to the emulsion.

Propitiation of Silver Halide Emulsion B

Silver chloroiodobromide core grains were prepared which were composed of 60 mole % of silver chloride, 1.5 mole % of silver iodide and remaining part of silver bromide, and have an average thickness of 0.05 μm and an average diameter of 0.15 μm. To the core grains, $2\times10^{-8}$ moles per mole of silver of $K_3Rh(H_2O)Br_5$ was added during the mixing process. On each the core grains, a shell was formed by a double-jet mixing method. During the shell formation, $3\times10^{-7}$ moles per mole of silver of $K_2IrCl_6$ was added. Thus obtained emulsion was a tabular grain monodisperse silver chloroiodobromide emulsion having an average thickness of 0.10 μm, an average diameter of 0.42 μm and a grain size variation coefficient of 10%. The grains were composed of 90 mole % of silver chloride, 0.2 mole % of silver iodide and the remaining part of silver bromide. Then the emulsion was desalted by making use of a modified gelatin described in JP O.P.I. No. 2-280139 which is a gelatin modified by substituting an amino group of gelatin with a phenylcarbamoyl group such as Compound G-8 exemplified on page 287(3) of the above Japanese patent publication. The value of $E_{Ag}$ of the desalted emulsion was 180 mV at 50° C.

To thus obtained emulsion, $1\times10^{-3}$ moles per mole silver of 4-hydroxy-6-methyl-1,3,3a,7-tetrazaindene was added. Further, potassium bromide and citric acid were added to the emulsion to adjust the values of pH and $E_{Ag}$ to 5.6 and 123 mV, respectively. Then $2\times10^{-5}$ moles of auric chloride and $3\times10^{-5}$ moles of N,N,N'-trimethyl-N'-heptafluoroselenourea were added to the emulsion The emulsion was chemically ripened at 60° C. so as to attain to the maximum sensitivity of the emulsion. After completion of the ripening, $2\times10^{-3}$ moles per mole silver of 4-hydroxy-6-methyl-1,3,3a-tetrazaindene, $3\times10^{-4}$ moles per mole of silver of 1-phenyl-5-mercaptotetrazole and gelatin were added to the emulsion.

Preparation of Scanner Silver Halide Photographic Material for Graphic Arts

On the above mentioned films of the invention and the comparative film, a gelatin undercoating layer according to the following Recipe 1 was coated so as the coated gelatin amount to be 0.5 g/m$^2$. On the undercoating layer, an emulsion layer 1 according to the following Recipe 2 was coated so as the amounts of silver and gelatin to be 2.9 g/m$^2$ and 1.0 g/m$^2$, respectively. An inter layer according to the following Recipe 3 was coated on the emulsion layer so as the coating amount of gelatin to 0.3 g/m$^2$. Further an emulsion layer 2 according to the following Recipe 4 so as the coating amounts of silver and gelatin to be 0.2/m$^2$ and 0.4 g/m$^2$, respectively. Furthermore, on the emulsion layer 2, a coating solution according to Recipe 5 was simultaneously coated so as the coating amount of gelatin to be 0/6 g/m$^2$. On the subbing layer of the opposite side of the support, a backing layer according to the following Recipe 6 was coated so as the coating amount of gelatin to be 0.6 g/m$^2$. On the backing layer, a hydrophobic polymer layer according to the following Recipe 7 and a backing protective layer according to the following Recipe 8 were coating simultaneously so as the coating amount of the backing protective layer to be 0.4 g/m$^2$.

Recipe 1 (Composition of gelatin undercoating layer)

| | |
|---|---|
| Gelatin | 0.5 g/m$^2$ |
| Dye a (powdered to particle size of | 25 mg/m$^2$ |

-continued

| | |
|---|---|
| 0.1 μm by a ball mill.) | |
| Dye b (powdered to particle size of 0.1 μm by a ball mill.) | 20 mg/m$^2$ |
| Sodium polystyrenesulfate | 10 mg/m$^2$ |
| S-1 (sodium-i-amyl-n-decylsulfosuccinate) | 0.4 mg/m$^2$ |

Recipe 2 (Composition of emulsion layer 1)

| | |
|---|---|
| Silver halide emulsion A (in terms of silver) | 2.9 g/m$^2$ |
| Sensitizing dye d-1 | 6 mg/m$^2$ |
| Sensitizing dye d-2 | 3 mg/m$^2$ |
| Hydrazine derivative HY-1 | 30 g/m$^2$ |
| Nucleation accelerating agent AM-1 | 40 mg/m$^2$ |
| Compound e | 100 mg/m$^2$ |
| Latex polymer f | 1.0 g/m$^2$ |
| Hardener g | 5 mg/m$^2$ |
| S-1 | 0.7 mg/m$^2$ |
| 2-Mercapto-6-hydroxypurine | 10 mg/m$^2$ |
| EDTA | 50 mg/m$^2$ |

Recipe 3 (Composition of inter layer)

| | |
|---|---|
| Gelatin | 0.3 g/m$^2$ |
| S-1 | 2 mg/m$^2$ |

Recipe 4 (Composition of emulsion layer 2)

| | |
|---|---|
| Silver halide emulsion B (in terms of silver) | 0.2 g/m$^2$ |
| Sensitizing dye d-1 | 0.5 mg/m$^2$ |
| Redox compound RE-1 | 4 mg/m$^2$ |
| S-1 | 1.7 mg/m$^2$ |

Recipe 5 (Composition of emulsion protective layer)

| | |
|---|---|
| Gelatin | 0.6 g/m$^2$ |
| Dye c (powdered to particle size of 0.1 μm by a ball mill.) | 40 mg/m$^2$ |
| S-1 | 12 mg/m$^2$ |
| Matting agent (monodisperse silica of an average size of 3.5 μm) | 25 mg/m$^2$ |
| 1,3-Vinylsulfonyl-2-propanol | 40 mg/m$^2$ |
| Surfactant h | 1 mg/m$^2$ |
| Colloidal silica (average size of 0.05 μm) | 20 mg/m$^2$ |
| Hardener j | 30 mg/m$^2$ |

Recipe 6 (Composition of backing layer)

| | |
|---|---|
| Gelatin | 0.6 g/m$^2$ |
| S-1 | 5 mg/m$^2$ |
| Latex polymer f | 0.3 g/m$^2$ |
| Colloidal silica (average size of 0.05 μm) | 70 mg/m$^2$ |
| Sodium polystyrenesulfate | 20 mg/m$^2$ |
| Compound i | 100 mg/m$^2$ |

Recipe 7 (Composition of hydrophobic polymer layer)

| | |
|---|---|
| Latex (methyl methacrylate:Acrylic acid = 97:3) | 1.0 g/m$^2$ |
| Hardener g | 6 mg/m$^2$ |

Recipe 8 (Composition of backing protective layer)

| | |
|---|---|
| Gelatin | 0.4 g/m$^2$ |
| Matting agent (polymethyl methacrylate of an average size of 5 μm) | 50 mg/m$^2$ |
| Sodium di-(2-ethylhexyl)-sulfosuccinate | 10 mg/m$^2$ |
| Surfactant h | 1 mg/m$^2$ |
| Dye k | 20 mg/m$^2$ |
| $H-(OCH_2CH_2)_{68}-OH$ | 50 mg/m$^2$ |
| Hardener j | 20 mg/m$^2$ |

Sensitizing dye d-1

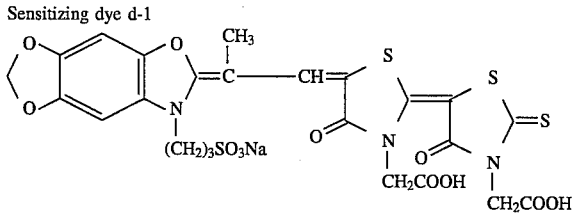

-continued
Compound e
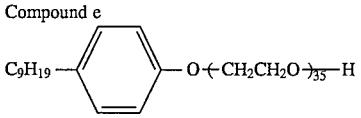
Latex polymer f
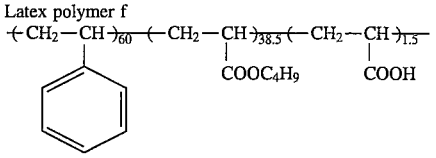
Hardener g
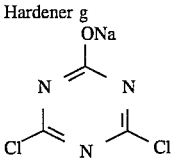
Hardener j
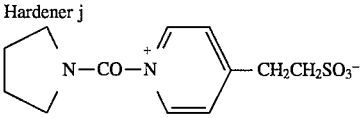
Surfactant h
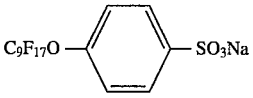
Compound i
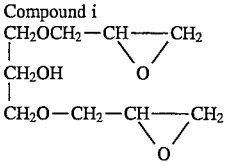
Dye k
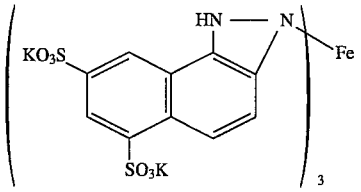
Dye b
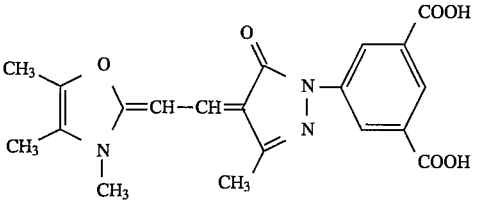
Dye a
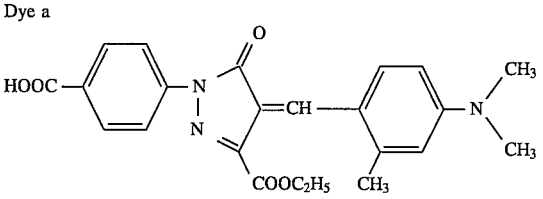

-continued

Sensitizing dye d-2

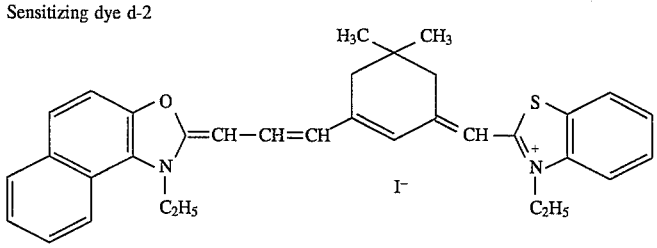

Hydrazine derivative HY-1

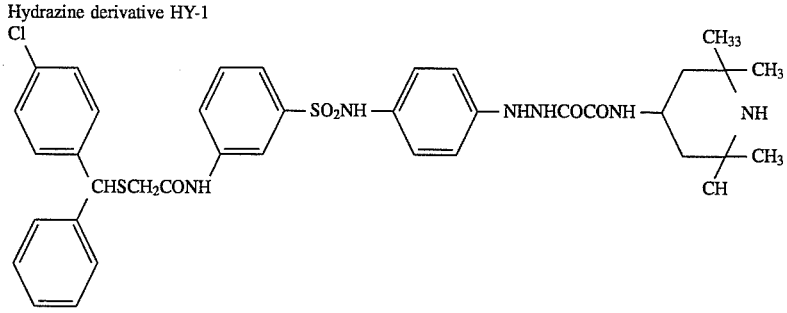

Nucleation accelerating agent AM-1

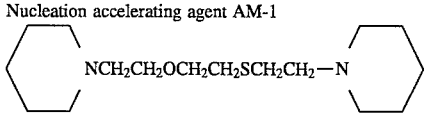

Redox compound RE-1

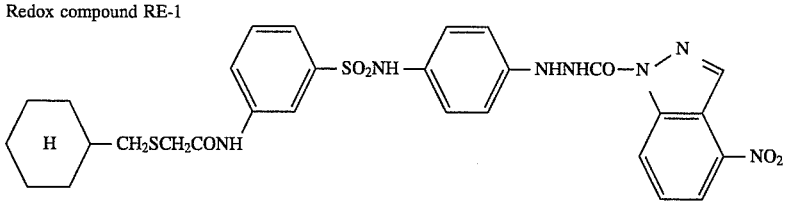

Dye c

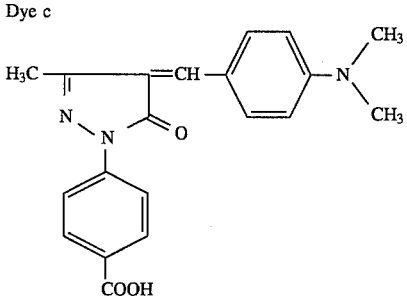

The specific resistivity of the surface of the backing side after drying was $5\times10^{11}$ Ω/□ at 23° C. and RH of 20%. The obtained samples are each contacted with a step wedge and exposed to light of 670 nm as a simulation of red laser light. The exposed samples were processed under the following condition by an automatic processor for rapid processing, GR-26SR manufactured by Konica Crop. using a developer and a fixer each having the following compositions. On the other hand, the samples are each exposed through FM Screen having a random pattern dot image of 16 μm by a scanner, Scanagraph SG-747RU, manufactured by Dai-Nihon Screen Co., and processed the same as above for evaluating the quality of small dots. Further, films each of which has a size of 508 mm×610 mm and 80% of the area thereof was exposed to be blackened, were processed in a rate of 100 sheets per day. The processing was run for 8 days and the number of processed film was 800 sheets in total.

While the running of the processing, the developer and the fixer were each replenished in a rate of 120 ml per square meter of the processed film. The photographic properties of the sample processed at the start of running and that processed by the processing solutions after the running of processing by 800 sheets were compared. The specific surface resistivity of the backing side was $9\times10^{11}$ Ω/□ at 23° C. and a RH of 20%.

Composition of Developer

| Concentrated developer A | |
|---|---|
| Pentasodium diethylenetriaminepentaacetate | 9 g/l |
| Compound A-39 represented by Formula (1) | 0.6 mole/l |
| Sodium sulfite | 0.45 mole/l |
| 1-Phenyl-4-methyl-4- | 7 g/l |

-continued

| Concentrated developer A | |
|---|---|
| hydroxymethyl-3-pyrazolidone | |
| Potassium carbonate | 2.4 mole/l |
| 5-Methylbenzotriazole | 0.75 g/l |
| Potassium bromide | 22 g/l |
| Boric acid | 6 g/l |
| Diethylene glycol | 80 g/l |
| Compound 1-7 represented by Formula (2) | 0.3 g/l |

KOH: An amount necessary for make pH value to 10.0 when the solution was made to a solution for use.

| Concentrated developer A' | |
|---|---|
| Pentasodium diethylenetriaminepentaacetate | 9 g/l |
| Sodium sulfite | 0.45 mole/l |
| 1-Phenyl-4-methyl-4-hydroxymethyl-3-pyrazolidone | 7 g/l |
| Potassium carbonate | 2.4 mole/l |
| 5-Methylbenzotriazole | 0.75 g/l |
| Potassium bromide | 22 g/l |
| Boric acid | 6 g/l |
| Hydroquinone | 18 g/l |
| Diethylene glycol | 80 g/l |
| Compound 1-7 represented by Formula (2) | 0.3 g/l |

KOH: An amount necessary for make pH value to 10.0 when the solution was made to a solution for use.

At a using time, 1 part to the above concentrated developer A and A' were each diluted with 2 parts of water for preparing a using solution. The using solution was used as both of a developer working solution and a developer replenishing solution.

Composition of Fixer

| Concentrated fixer A | |
|---|---|
| Ammonium thiosulfate (70% aqueous solution) | 400 ml/l |
| Sodium sulfite | 45 g/l |
| Boric acid | 20 g/l |
| Sodium acetate trihydrate | 70 g/l |
| Acetic acid (90% aqueous solution) | 30 g/l |
| Tartaric acid | 6 g/l |
| Glutaraldehyde | 6 g/l |

pH was adjusted by sulfuric acid so as the pH value of using solution to be 4.9

At a using time, 1 part to the above concentrated fixer A was diluted with 2 parts of water for preparing a using solution. The using solution was used as both of a fixer working solution and a fixer replenishing solution.

| | (Processing condition) | |
|---|---|---|
| (Process) | (Temperature) | (Time) |
| Developing | 38° C. | 12 sec. |
| Fixing | 35° C. | 10 sec. |
| Washing | 40° C. | 10 sec. |
| Drying | 50° C. | 12 sec. |
| Total | | 44 sec. |

Evaluation of Drying Ability in the Automatic Processing Machine

The dried condition of the sample was evaluated by finger touch feeling at the time at which the sample was discharged from the drying process and classified for five ranks. The moisture remained in the sample was larger in the order of ranks 5 to 1. The sample completely dried at the time of evaluation was classified at rank 5 the sample on the surface which water drops were remained, was classified at rank 1. Samples of ranks 4 and 5 were suitable for practical use.

Evaluation of Sensitivity and Gamma Value

The obtained developed samples were subjected to densitometry by Konica digital densitometer PDA-65. Sensitivities shown in the table are relative value when the sensitivity of sample 101 measured at a density of 3.0 is set 100. Gamma values are each expressed by a tangent of an angle formed by a strait line connecting between density points of 0.1 to 3.0 on a photographic characteristic curve and a horizontal line or density axis. A light-sensitive material having a gamma value of less than 7 shows that the light-sensitive material is not usable, and that having a value of 7 to 10 shows that the light-sensitive material is usable but insufficient. A light-sensitive material having a gamma value 10 or more gives a ultra high contrast image and is sufficiently usable in the practical use.

Evaluation of Fog

The density of a non-exposed area of the processed sample was measured by Konica digital densitometer PDA-65. A value of 0.06 or more is not acceptable for practical use.

Method for Evaluation of Dot Quality

The quality or sharpness of a medium dots (about 50% dot) obtained by exposure by SG-747RU through a 16 μm random pattern screen (FM screen) was evaluated by observing through a magnifier of 100 magnifications. The dot quality was ranked in 5 ranks. Rank 5 represent the best quality and the ranks were lowered 4 to 1 according to lowering the dot quality. Ranks 2 and 1 correspond to the dot quality undesirable for practical use.

Test results are shown below.

| Sample No. | Support | Thickness | Adhesive layer |
|---|---|---|---|
| 101 (Comparative) | PET | 100 μm | Vinylidene chloride |
| 102 (Comparative) | PET | 100 μm | Styrene/glycidyl acrylate |
| 103 (Inventive) | SPS | 100 μm | Vinylidene chloride |
| 104 (Inventive) | SPS | 100 μm | Styrene/butadiene |
| 105 (Inventive) | SPS | 100 μm | Styrene/glycidyl acrylate |
| 106 (Inventive) | SPS | 100 μm | Gelatin |
| 107 (Comparative) | PET | 100 μm | Styrene/glycidyl acrylate |
| 108 (Inventive) | SPS | 100 μm | Styrene/glycidyl acrylate |

| Sample | Dryness | | Sens. | | Gamma | | Fog | | DQ | | |
|---|---|---|---|---|---|---|---|---|---|---|---|
| No. | Be. | Af. | Be. | Af. | Be. | Af. | Be. | Af. | Be. | Af. | |
| | | | | | (Developer A) | | | | | | |
| 101 | 4 | 3 | 100 | 85 | 9.5 | 6.5 | 0.02 | 0.07 | 4 | 2 | Comp |
| 102 | 3 | 3 | 100 | 85 | 9.5 | 6 | 0.03 | 0.07 | 4 | 2 | Comp |
| 103 | 5 | 5 | 100 | 104 | 10.5 | 10.5 | 0.02 | 0.02 | 5 | 5 | Inv. |
| 104 | 5 | 5 | 100 | 103 | 10.5 | 10.5 | 0.02 | 0.02 | 5 | 5 | Inv. |
| 105 | 5 | 5 | 100 | 104 | 10.5 | 10.5 | 0.02 | 0.02 | 5 | 5 | Inv. |
| 106 | 4 | 4 | 100 | 95 | 10.5 | 9.5 | 0.02 | 0.04 | 5 | 4 | Inv. |
| | | | | | (Developer A') | | | | | | |
| 107 | 3 | 3 | 100 | 75 | 9.5 | 5.5 | 0.03 | 0.09 | 5 | 5 | Comp |
| 108 | 4 | 4 | 100 | 88 | 9.5 | 8 | 0.02 | 0.05 | 5 | 4 | Inv. |

(In the above, "Be." and "Af." are each means "Before running of processing" and After running of processing", respectively, and DQ is dot quality.)

It is understood that in the scanner silver halide photographic light-sensitive material for graphic arts, in which a hydrazine derivative is contained and a SPS support is used, degradation in the dryness, variation in the sensitivity and contrast and increasing in fogging are small, even when a lot of the light-sensitive material is processed in an automatic processor while replenishing with lowered amounts of developer replenisher and fixer replenisher. Degradation in the dot quality and the for reproducibility in the small dot are also small under the above-mentioned condition.

Example 2

Preparation of Silver Halide Emulsion C

A monodisperse silver chlorobromide emulsion having an average particle diameter of 0.10 μm with a variation coefficient of 10% and composed of 99 mole % of silver chloride and remaining part of silver bromide was prepared by a double-jet mixing process. In the course of the mixing process, $K_3Os(H_2O)Cl_5$ and $K_2IrCl_6$ were added in an mounts of $8\times10^{-5}$ moles and $3\times10^{-7}$ moles per mole of silver.

The emulsion was chemically ripened for attaining a maximum sensitivity after addition of 4-hydroxy-6-methyl-1,3,3a,7-tetrazaindene, citric acid and $3\times10^{-6}$ mole per mole of silver of elemental sulfur. After completion of the ripening, 4-hydroxy-6-methyl-1,3,3a,7-tetrazaindene, $3\times10^{-4}$ moles of 1-phenyl-5-mercaptotetrazole and gelatin were added to the emulsion.

Preparation of a Daylight Room Contact Printing Silver Halide Photographic Light-Sensitive Material for Graphic Arts On the subbing layer of a side of the film of the invention or that of the comparative film, a gelatin undercoating layer according to the following Recipe 9 was coated so as the coated amount of gelatin to be 0.5 g/m$^2$. On the undercoating layer, a silver halide emulsion layer according to the following Recipe 10 was coated so as the coated amount of silver and gelatin to be 2.8 g/m$^2$ and 1.0 g/m$^2$, respectively. Further on the emulsion layer a protective layer according to Recipe 11 was coated so as the coated amount of gelatin to be 0.5 g/m$^2$. The above layers were coated simultaneously. On the subbing layer of opposite side, an electric conductive layer according to Example 1 of JP O.P.I. No. 5-188518, p.p. 360(14)-361(15) was coated. After that, a backing layer according to Recipe 12 was coated so as the coated amount of gelatin to be 0.4 g/m$^2$. On the backing layer a hydrophobic polymer layer and a backing protective layer were coated so as the coated amount of gelatin of the protective layer to be 0.4 g/m$^2$. The above three layer were coated simultaneously. Thus samples were prepared.

| Recipe 9 (Composition of gelatin under-coat layer) | |
|---|---|
| Gelatin | 0.5 g/m$^2$ |
| Dye b (powdered to particle size of 0.1 μm by a ball mill.) | 20 mg/m$^2$ |
| Dye c (powdered to particle size of 0.1 μm by a ball mill.) | 10 mg/m$^2$ |
| Styrene/maleic acid hydrophilic copolymer (thickener) | 10 mg/m$^2$ |
| S-1 (sodium-i-amiyl-n-decylsulfosuccinate) | 0.4 mg/m$^2$ |
| **Recipe 10 (Composition of emulsion layer)** | |
| Silver halide emulsion C (in terms of silver) | 2.8 g/m$^2$ |
| Tetrazolium compound TE-1 | 30 mg/m$^2$ |
| Sodium dodecybenzenesulfonate | 10 mg/m$^2$ |
| 5-Methylbenzotriazole | 10 mg/m$^2$ |
| Latex polymer f | 1.0 g/m$^2$ |
| Hardener j | 40 mg/m$^2$ |
| S-1 | 0.7 mg/m$^2$ |
| Styrene/maleic acid hydrophilic copolymer (thickener) | 20 mg/m$^2$ |
| **Recipe 11 (Composition of emulsion protective layer)** | |
| Gelatin | 0.5 g/m$^2$ |
| Dye c (powdered to particle size of 0.1 μm by a ball mill.) | 100 mg/m$^2$ |
| S-1 | 12 mg/m$^2$ |
| Matting agent (monodisperse silica of an average size of 3 μm) | 15 mg/m$^2$ |
| Matting agent (monodisperse silica of an average size of 8 μm) | 20 mg/m$^2$ |
| 1,3-Vinylsulfonyl-2-propanol | 50 mg/m$^2$ |
| Surfactant h | 1 mg/m$^2$ |
| Colloidal silica (average size of 0.05 μm) | 20 mg/m$^2$ |
| Hardener j | 50 mg/m$^2$ |
| **Recipe 12 (Composition of backing layer)** | |
| Gelatin | 0.4 g/m$^2$ |
| S-1 | 5 mg/m$^2$ |
| Latex polymer f | 0.3 g/m$^2$ |
| Colloidal silica (average size of 0.05 μm) | 70 mg/m$^2$ |
| Styrene/maleic acid hydrophilic copolymer (thickener) | 20 mg/m$^2$ |
| Compound i | 100 mg/m$^2$ |

-continued

| Recipe 13 (Composition of hydrophobic polymer layer) | |
|---|---|
| Latex (styrene:butadiene:acrylic acid = 30:65:5) | 1.0 g/m$^2$ |
| Hardener j | 10 mg/m$^2$ |
| **Recipe 14 (Composition of backing protective layer)** | |
| Gelatin | 0.4 g/m$^2$ |
| Matting agent (polymethyl methacrylate of an average size of 5 μm) | 50 mg/m$^2$ |
| Sodium di-(2-ethylhexyl)-sulfosuccinate | 10 mg/m$^2$ |
| Surfactant h | 1 mg/m$^2$ |
| $H-(OCH_2CH_2)_{68}-OH$ | 50 mg/m$^2$ |
| Hardener j | 40 mg/m$^2$ |

TE-1

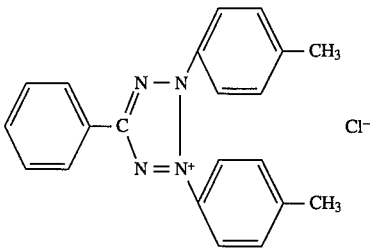

The specific resistivity of the surface of the baking side after dried was $1\times10^{11}$ Ω/□ at 23° C. and a RH of 20%. Thus obtained samples were each contacted with a step wedge and exposed to light in a daylight room printer P-627GM manufactured by Dai-Nihon screen Co. Then the samples were processed the following developer and fixer in an automatic processor SRX-1001, manufactured by Konica Corp., which was modified to change the line speed so as the total processing time (dry to dry) to be 30 seconds at a developing temperature of 38° C. For evaluating the dot quality of extremely small dot, the samples were exposed in the room-light printer through a processed piece of Sample 106 prepared in Example 1 as an original image. Further, films each having 508 mm×610 mm size and 80% of the area thereof was blackened were processed in a rate of 200 sheets per day. The processing was run for 4 days and the number of processed film was 800 sheets in total. While the running of the processing, the developer and the fixer were each replenished in a rate of 120 ml per 1 m$^2$ of the processed film. The properties before running and that after the running of processing by 800 sheets were compared. The specific surface resistivity of the backing side was $9\times10^{11}$ Ω/□ at 23° C. and a RH of 20%.

Composition of Developer

Amounts for 1 liter of using solution

| Developer B | |
|---|---|
| Ammonia water (25%) | 50 ml |
| Pentasodium diethylaminepentaacetate | 0.15 moles |
| Sodium sulfite | 20 g |
| Boric acid | 8 g |
| Potassium bromide | 15 g |
| Potassium carbonate | 40 g |
| Compound 2-b-29 of Formula (2) | 60 mg |
| Diethylene glycol | 40 g |
| Benzotriazole | 0.2 g |
| $FeSO_4(NH_4)_2SO_4.6H_2O$ | 0.15 moles |
| 1-Phenyl-4-hydroxymethyl-3-pyrazolidone | 0.9 g |
| Adjust pH by potassium hydroxide to 9.2 | |
| Fixer B | |
| Amounts for 1 liter of using solution | |
| Sodium thiosulfate | 100 g/l |
| Sodium sulfite | 22 g/l |
| Boric acid | 10 g/l |
| Sodium acetate trihydrate | 34 g/l |
| Tartaric acid | 3.0 g/l |
| Adduct of glutaraldehyde with sulfite | 0.1 moles/l |

Adjust pH by acetic acid to 7.5

The evaluations were performed the same as in Example 1 other the followings. Results are shown below.

Evaluation of Reproducibility of Extreme Small Dot

A percentage of dots in a negative image was measured, which was printed by a contact printer through small dots or 5% dot of the original with an exposure amount necessary to form a solid density of 5.0 at an area of the original. The percentage near 95% shows a high small dot reproducibility.

Evaluation Method of Dot Quality

The dot quality of negative image printed through the original having small dots or 5%-dots evaluated by observation through a magnifier of 100 magnifications. The dot quality was ranked in 5 ranks. Rank 5 represent the best quality and the ranks were lowered 4 to 1 according to lowering the dot quality. Ranks 2 and 1 correspond to the dot quality undesirable for practical use.

Test results are shown below.

| Sample No. | Support | Thickness | Adhesive layer |
|---|---|---|---|
| 201 (Comparative) | PET | 100 μm | Vinylidene chloride |
| 202 (Comparative) | PET | 100 μm | Styrene/glycidyl acrylate |
| 203 (Inventive) | SPS | 100 μm | Vinylidene chloride |
| 204 (Inventive) | SPS | 100 μm | Styrene/butadiene |
| 205 (Inventive) | SPS | 100 μm | Styrene/glycidyl acrylate |
| 206 (Inventive) | SPS | 100 μm | Gelatin |

| Sample | Dryness | | Sens. | | Gamma | | Fog | | DQ | | D rep. | | |
|---|---|---|---|---|---|---|---|---|---|---|---|---|---|
| No. | Be. | Af. | Be. | Af. | Be. | Af. | Be. | Af. | Be. | Af. | Be. | Af. | |
| 201 | 4 | 3 | 100 | 75 | 9 | 6.5 | 0.02 | 0.06 | 96 | 99 | 4 | 2 | C |
| 202 | 4 | 3 | 100 | 75 | 9 | 6 | 0.02 | 0.06 | 96 | 99 | 4 | 2 | C |
| 203 | 5 | 5 | 100 | 98 | 10 | 10 | 0.02 | 0.02 | 95 | 95 | 5 | 5 | I |
| 204 | 5 | 5 | 100 | 98 | 10 | 10 | 0.02 | 0.02 | 95 | 95 | 5 | 5 | I |
| 205 | 4 | 4 | 100 | 98 | 10 | 10 | 0.02 | 0.02 | 95 | 95 | 4 | 4 | I |
| 206 | 4 | 4 | 100 | 92 | 10 | 9 | 0.02 | 0.04 | 96 | 96 | 4 | 4 | I |

(In the above, "D rep." dot reproducibility. C and I are comparative example and inventive example, respectively.)

It is understood that in the daylight room printing contacting silver halide photographic light-sensitive material for graphic arts, in which a hydrazine derivative is contained and a SPS support is used, degradation in the dryness, variation in the sensitivity and contrast, and increasing in fogging are small, even when a lot of the light-sensitive material is processed in an automatic processor while replenishing with lowered amounts of developer replenisher and fixer replenisher. Degradation in the dot quality and the dot reproducibility in the extreme small dot are also small under the above-mentioned condition.

Example 3

A cathode 1 was provided in an exhausted developer solution formed after processing of 800 sheets of film in Example 2, and an anode 1 was provided in a electrolyte solution 1. Both of the solutions were contacted together with through an anion-exchange membrane and an electric current of 0.1 A/dm$^2$ at 2 V was applied for 6 hours to regenerate the exhaust solution.

Cathode 1: Stainless steel

Anode 1: Platinum plated titanium

Electrolyte solution 1: 10% solution of KCl

Anion-exchange membrane: Selemion AWV/ASR manufactured by Asahi Glass Co.

No precipitation was formed after regeneration. The regenerated solution was refilled in the developing tank and test was performed in the same manner as in Example 2. In the samples using SPS support, test results similar to those in Example 2 were obtained.

Example 4

In the same manner as in Example 2, 1000 m$^2$ of each sample was continuously processed. The cathode 1 was provided in the developing tank and the anode 1 is provided in an electrolyte solution which was connected with an exhaust developer tank through the anion-exchange membrane 1. While the processing, an electric current of 0.1 A/dm$^2$ at 2 V was applied between the electrodes for regeneration. Any change in the photographic characteristics was not observed in the samples using the SPS support. Contrary to that, the sensitivity, gamma and dot quality of the samples using PET support were degraded.

Example 5

Preparation of Medical X-Ray Photographic Material

Light-Sensitive Material-1

Preparation of seed emulsion-1

Seed emulsion-1 was prepared as follows.

| | | |
|---|---|---|
| A1 | Ossein gelatin | 24.2 g |
| | water | 9657 ml |
| | Sodium polypropyleneoxy-polyethyleneoxy-disuccinate (10% methanol solution) | 6.78 ml |
| | Potassium bromide | 10.8 g |
| | 10% Nitric acid | 114 ml |
| B1 | 2.5 N Silver nitrate aqueous solution | 2825 ml |
| C1 | Potassium bromide | 841 g |
| | Water to make | 2825 ml |
| D1 | 1.75 N Potassium bromide aqueous solution: an amount necessary for silver potential control | |

To Solution A1, 464.3 ml of Solution B1 and the same amount of Solution C1 were added spending 1.5 minutes at 42° C. by a double-jet method by making use of a stirring mixer described in JP Nos. 58-58288/1977 and 58-58289/1977, to form nuclei.

After completion of addition of Solutions A1 and C1, the temperature of Solution A1 was raised by 60° C. spending 60 minutes and the pH value of the solution was adjusted to 5.0 using a 3% solution of KOH. Then Solutions B1 and C1 were added to the solution respectively by a double-jet method for 42 minutes with a flow rate of 55.4 ml/min. The silver electrode potential, which was measured by using a saturated silver-silver chloride electrode as a comparative electrode and a silver ion selective electrode, during the temperature raising step and the mixing step of Solutions A1 and B1 were controlled at +8 mV and +16 mV, respectively, using Solution D1.

After completion of the addition, the solution was adjusted at a pH of 6 by a 3% solution of KOH and was immediately desalted and washed. As to thus obtained seed emulsion, it was confirmed by electron microscopic observation that the slum of projection area of hexagonal tabular silver halide grains each having a maximum ratio of neighboring side of 1.0 to 2.0 occupied 90% of the total projection area of whole silver halide grains, and the average thickness and the average grain size in terms of circle diameter of the hexagonal tabular grains were 0.064 μm and 0.595 μm, respectively. The variation coefficient of thickness and that of the distance between twin surfaces of the grains were 40% and 42%, respectively.

Preparation of Em-1

A tabular grain silver halide emulsion Em-1 was prepared using Seed emulsion-1 and the following four kinds of solutions.

| | | |
|---|---|---|
| A2 | Ossein gelatin | 34.03 g |
| | Sodium polypropyleneoxy-polyethyleneoxy-disuccinate (10% methanol solution) | 2.25 ml |
| | Seed emulsion-1: an amount corresponding to 1.218 moles | |
| | Water to make | 3150 ml |
| B2 | Potassium bromide | 1734 g |
| | Water to make | 3644 ml |
| C2 | Silver nitrate | 2478 g |
| | Water to make | 4165 ml |
| D2 | Fine grain emulsion composed of 3% by weight of gelatin and silver iodide grains having an average size of 0.05 μm*: an amount corresponding to 0.080 moles | |

*: To 6.64 liter of a solution containing 5.0% by weight of gelatin and 0.06 moles of potassium iodide, 2 liter of a solution containing 7.06 moles of silver nitrate and the same amount of a solution containing 7.06 moles of potassium iodide were added spending 10 minutes. The pH value and temperature of the solution during the grain formation were controlled at 2.0 and 40° C. respectively. After completion of grain formation, the pH value was adjusted to 6.0.

A part of Solution B2, a part of Solution C2 and a half of Solution D2 were added spending 5 minutes to Solution A2 which was vigorously stirred in a reaction vessel maintaining at 60° C. Then a half of the remained Solution B2 and a half of remained Solution C2 were added spending 37 minutes. Further a part of remained Solution B2, a part of remained Solution C2 and all of remained Solution D2 were added for 15 minutes. After that, all of remained solutions B2 and C2 were finally added spending 33 minutes. During the above steps, values of pH and pAg were each maintained at 5.8 and 8.8, respectively. The adding rate of Solution B2 and C2 were functionally varied corresponding to the critical growing speed of grains.

Further, Solution D was added in an amount corresponding to 0.15 mole % with respect to the total amount of silver.

After completion of the addition, the emulsion was cooled by 40° C. and 1800 ml of a solution containing 13.8% by weight of phenylcarbamoyl-modified gelatin with a substituted degree of 90% was added to the emulsion as a macromolecular flocculation agent. After stirring for 3 minutes, a 56 weight percent solution of acetic acid was added to adjust the pH value to 4.6. The emulsion was stood for 20 minutes after stirring for 3 minutes, and a upper clear liquid was removed by decantation. Then 9.0 l of distilled water was added at 40° C. and was stirred and stood for removing a upper clear liquid. The similar process was repeated using 11.25 l of distilled water. After removing the upper liquid, a gelatin solution and a 105 sodium carbonate solution were added to adjust pH to 5.08. The emulsion was redispersed by stirring for 30 minutes at 50° C. The pH and pAg of the emulsion were adjusted to 5.8 and 8.06 at 40° C., respectively, after the redispersion.

By electron microscopic observation, thus obtained silver halide emulsion was one composed of tabular silver halide grains having an average size of 1.11 μm, an average thickness of 0.25 μm, an average aspect ration of about 4.5 and a grain size distribution width of 18.1%. The average distance between twin surfaces of the grains was 0.020 μm and the number of grains each having a ratio of the distance between twin surfaces to the thickness of not less than 5 occupied 97% of the whole number of grains in the emulsion. Grains having the above ratio of not less than 10 and those having the ratio of not less than 15 each occupied 49% and 17% of the whole grains in number, respectively.

A prescribed amount of a sensitizing dye in a form of fine particle dispersion was added to the above Em-1 at 60° C. Then an aqueous mixture solution of adenine, ammonium thiocyanate, auric chloride and sodium thiosulfate and a dispersion liquid of triphenylphosphine selenide were added. The emulsion was subjected to a ripening for 120 minutes in total, 60 minutes after starting the ripening a silver iodide fine grain emulsion was added. At the end of the ripening a prescribed amount of 4-hydroxy-6-methyl-1,3,3a,7-tetrazaindene (TAI) was added as a stabilizer.

The amount of the above-mentioned additives per mole of silver halide are described below.

| | |
|---|---|
| Sodium salt of 5,5p'-dichloro-9-ethyl-3,3p'-di(3-sulfopropyl)-oxacarbocyanine anhydrous | 2.0 mg |
| Sodium salt of 5,5p'-di-(butoxycarbonyl)-1,1p'-diethyl-3,3p'-di-(4-sulfobutyl)-benzimidazolocarbocyanine anhydrous | 120 mg |
| Adenine | 15 mg |
| Potassium thiocyanate | 95 mg |
| Auric chloride | 2.5 mg |
| Sodium thiosulfate | 2.0 mg |
| Triphenylphosphine selenide | 0.4 mg |
| Fine particles of silver iodide | 280 mg |
| 4-Hydroxy-6-methyl-1,3,3a,7-tetrazaindene | 500 mg |

The fine solid particle dispersions of spectral sensitizing dye was prepared according to a method described in JP O.P.I. No. 5-297496/1993. An prescribed amount of a spectral sensitizer was added into water adjusted at 27° C. and dispersed by stirring by a high-speed stirring mixing machine or dissolver at 3,500 rpm for 30 to 120 minutes.

The dispersion of the selenium sensitizer was prepared as follows. In 30 kg of ethyl acetate at 50° C., 120 g of triphenylphosphine selenide was added and stirred to be completely dissolved. On the other hand, 3.8 kg of photographic gelatin was dissolved in 38 kg of pure water and 93 g of a 25% aqueous solution of sodium dodecylbenzenesulfate was added to the solution. Then the above two solutions were mixed and dispersed by a high-speed stirring dispersing machine having a dissolver of diameter of 10 cm with a circumferential speed of 40 m/sec for 30 minutes at 50° C. After that, the ethyl acetate was rapidly removed under a reduced pressure by stirring so as the remaining amount of ethyl acetate to be 0.3% or less. The dispersion was diluted with pure water to make the total amount to 80 kg. A part of thus obtained dispersion was taken and used in the above experiment.

The average silver iodide content at the outermost surface of the silver halide grains contained in emulsion Em-1 was made to about 4 mole % by addition of the silver iodide fine particles.

To the emulsion sensitized as follows, the additives mentioned below were added to prepare an emulsion layer coating solution. At the same time, a protective layer coating solution was also prepared.

Inventive and comparative film base were prepared, each of which was blue tinted with density of 0.15 and a cross-over cutting layers were preliminary provided on the both surface. On the both surfaces of the each film, the emulsion layer coating solution and the protective layer coating solution were simultaneously coated and dried in the order of that from the film surface so as the coating amounts thereof to be the followings.

| First layer (cross-over light shielding layer) | |
|---|---|
| Fine solid particle dispersion of dye (AH) | 180 mg/m$^2$ |
| Gelatin | 0.2 g/m$^2$ |
| Sodium dodecylbenzenesulfonate | 5 mg/m$^2$ |
| Compound (I) | 5 mg/m$^2$ |
| Sodium salt of 2,4-dichloro-6-hydroxy-1,3,5-triazine | 5 mg/m$^2$ |
| Colloidal silica (average size of 0.014 μm) | 10 mg/m$^2$ |
| Second layer (emulsion layer) | |
| The following additives were added to the above-mentioned emulsion. | |
| Compound (G) | 0.5 mg/m$^2$ |
| 2,6-Bis(hydroxyamino)-4-diethylamino-1,3,5-triazine | 5 mg/m$^2$ |
| t-Butylcathecol | 130 mg/m$^2$ |
| Polyvinylpyrrolidone (molecular weight 10,000) | 35 mg/m$^2$ |
| Styrene-maleic anhydride copolymer | 80 mg/m$^2$ |
| Sodium polystyrenesulfate | 80 mg/m$^2$ |
| Trimethylolpropane | 350 mg/m$^2$ |
| Diethylene glycol | 50 mg/m$^2$ |
| Nitrophenyl-triphenyl-phosphonium chloride | 20 mg/m$^2$ |
| Anmonium 1,3-dihydroxylbenzene-d-sulfonate | 500 mg/m$^2$ |
| Sodium 2-mercaptobenzimidazole-5-sulfonate | 5 mg/m$^2$ |
| Compound (H) $n\text{-}C_4H_9OCH_2CH(OH)CH_2N(CH_2COOH)_2$ | 0.5 mg/m$^2$ |
| Compound (M) | 5 mg/m$^2$ |
| Compound (N) | 5 mg/m$^2$ |
| Colloidal silica | 0.5 g/m$^2$ |
| Latex (L) | 0.2 g/m$^2$ |
| Dextrin (average molecular weight: 1,000) | 0.2 g/m$^2$ |
| The amount of gelatin was controlled so as to be | 1.0 g/m$^2$ |
| Third layer | |
| Gelatin | 0.8 g/m$^2$ |
| Matting agent of polymethacrylate (area average diameter: 7.0 μm) | 50 mg/m$^2$ |
| Formaldehyde | 20 mg/m$^2$ |
| Sodium salt of 2,4-Dichloro-6-hydroxy-1,3,5-triazine | 10 mg/m$^2$ |
| Bis-vinylsulfonylmethylether | 36 mg/m$^2$ |
| Latex (L) | 0.2 g/m$^2$ |
| Polyacrylamide (average molecular weight: 10,000) | 0.1 g/m$^2$ |
| Sodium polyacrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |

-continued

| | |
|---|---|
| Compound (O) | 50 mg/m$^2$ |
| Compound (S-2) | 5 mg/m$^2$ |
| $C_9F_{19}$—O—$(CH_2CH_2O)_{11}$—H | 3 mg/m$^2$ |
| $C_8F_{17}SO_2N(C_3H_7)(CH_2CH_2O)_{15}$—H | 2 mg/m$^2$ |
| $C_8F_{17}SO_2N(C_3H_7)(CH_2CH_2O)_4$—$(CH_2)_4SO_3Na$ | 1 mg/m$^2$ |

The coated amounts of the above materias are each for one side of the support. The coated amount of silver is adjusted so as to be 1.6 g/m$^2$ for one side.

Compound (G)

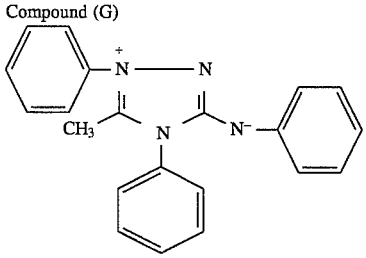

Compound (H)

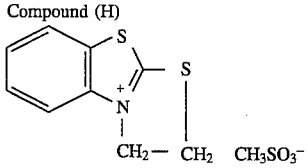

Compound (I)

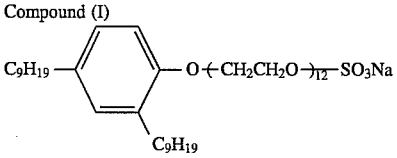

Compound (J)

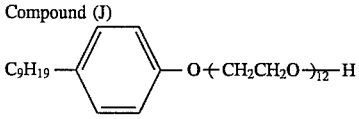

Compound (K)

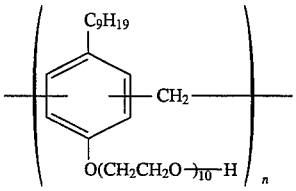

(n = mixture of 2 to 5)

Compound (S-1)

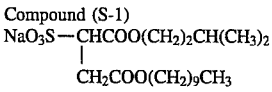

Compound (S-2)

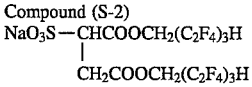

Latex (L)

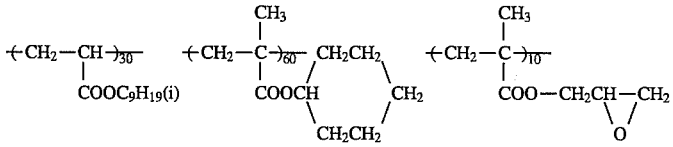

Polysiloxan (SI)

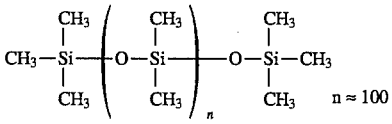

Fine particle solid dispersion dye (AH)

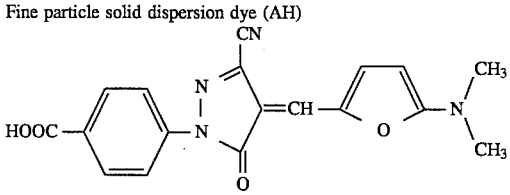

Compound (O)

$C_{11}H_{23}CONH(CH_2CH_2O)_5H$

Compound (M)

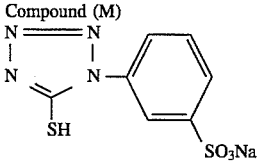

Compound (N)

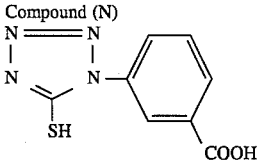

Developer replenishing tablets were prepared by the following operations (A) and (B).

Operation (A)

A developing agent, Compound A-39 of Formula (1-a), was powdered in a bantam mill available on the market so as the average particle size to be 10 μm. Thus obtained fine powder, 3000 g of sodium sulfite, 2000 g of potassium sulfite, 1000 g of 1-phenyl-4-methylhydroxymethyl-3-pyrazolidone were added and mixed in the mill for 30 minutes. The mixture was granulated with 30 ml of water in a stirring granulation machine for about 10 minutes at a room temperature. The obtained granules were dried at 40° C. for 2 hours to almost completely remove the moisture. The granules were uniformly mixed for 10 minutes with 100 g of polyethylene glycol 6000 by a mixing machine in a room conditioned at 25° C. and a RH of not more than 40%. The mixture was tableted by a tableting machine, modified Tough Press Collect 1527 HU manufactured by Kikusui Seisakusyo Co., Ltd., in a rate of 3.84 g per tablet. Thus 2500 of developer replenishing tablets A were prepared.

Operation (B)

A mixture of 100 g of DTPA, 4000 g of potassium carbonate, 10 g of 5-methylbenzotriazole, 7 g of 1-phenyl-5-mercaptotetrazole, 5 g of hypoxantine, 200 g of KOH and 10 g of N-acetyl-D,H-penicilamine as powdered and granulated in a manner similar to that in Operation (A). Adding amount of water was 30.0 ml. The obtained granules were dried at 50° C. for 30 minutes to almost completely remove the moisture. The mixture was tableted by a tableting machine, modified Tough Press Collect 1527 HU manufactured by Kikusui Seisakusyo Co., Ltd., in a rate of 1.73 g per tablet. Thus 2500 of developer replenishing tablets B were prepared.

Fixer replenisher tablets were prepared by the following operations (C) and (D).

Operation (C)

In a manner similar to that in operation (A), 1400 g of a mixture of ammonium thiosulfate and sodium thiosulfate (mixing ratio=70:30 by weight) and 1500 g of sodium sulfite were powdered and mixed in a mixing machine available on the market. The powder was granulated in a manner similar to that in operation (A) with 500 ml of water. After granulation, the granules were dried at 60° C. for 30 minutes to almost completely remove the moisture. To thus obtained granules 4 g of N-lauloylalanine was added and mixed for 3 minutes by a mixing machine in a room conditioned at 25° C. and a RH of not more than 40%. The mixture was tableted by a tableting machine, modified Tough Press Collect 1527 HU manufactured by Kikusui Seisakusyo Co., Ltd., in a rate of 6.202 g per tablet. Thus 2500 of fixer replenishing tablets C were prepared.

Operation (D)

In a manner similar to that in operation (A), 1000 g of boric acid, 1500 g of an adduct of glutaraldehyde with sulfite, 3000 g of sodium hydrogen acetate which was prepared by mixing and drying equal moles of sodium acetate and glacial acetic acid, and 200 g Of tartaric acid were powdered. The powder was granulated in a manner similar to that in operation (A) with 100 ml of water. After granulation, the granules were dried at 50° C. for 30 minutes to almost completely remove the moisture. To thus obtained granules 4 g of N-lauloylalanine was added and mixed for 3 minutes. The mixture was tableted by a tableting machine, modified Tough Press Collect 1527 HU manufactured by Kikusui Seisakusyo Co., Ltd., in a rate of 4.562 g per tablet. Thus 1250 of fixer replenishing tablets D were prepared.

| Starter for developer | |
|---|---|
| Glacial acetic acid | 2.98 g |
| KBr | 4.0 g |
| Water to make | 1 l |

A developer to be used at the starting time of processing or running of processing was prepared by dissolving 25 tables of developer replenisher A and 25 tablets of developer replenisher B in water and making to 1 liter. To 16.5 liter of thus prepared developer, 330 ml of the starter of developer was added to make a starting developer solution. The solution was filled in a developing tank. A fixer to be used at the starting time of processing or running of processing was prepared by dissolving 25 tables of fixer replenisher B and 12.5 tablets of fixer replenisher C in water and making to 1 liter. In a fixing tank, 9.2 liters of the above fixing solution was filled. The developing solution had a pH value of 10.45 after addition of the starter for developer.

The processing was run using the foregoing light-sensitive material which was exposed so as to form an optical density of 1.0 after the processing. A automatic processor SRX-502 was used, which was modified by providing a tablet supplying device and a heating roller as a drying device so as the processing speed to be 25 sec.

Two of table A, two of tablet B and 110 ml of water per square meter of the processed light-sensitive material were supplied to the developer in the course of the running of the processing. The pH value of the solution was 10.70. To the fixer, two of tablet C and one of tablet D and 105 ml of water were added per square meter of the processed light-sensitive material. The supplying of water was started at the time at which the tablet was supplied, and continued for 10 minutes in an equal flow rate which was approximately proportional with the dissolving rate of the tablet.

| Processing condition | | |
|---|---|---|
| Development | 35° C. | 8.2 sec. |
| Fixing | 33° C. | 5 sec. |
| Washing | Room temp. | 4.5 sec. |
| Squeezing | | 1.6 sec. |
| Drying | 40° C. | 5.7 sec. |
| Total | | 25 sec. |

The running of the processing was run for 5 days under the above conditions. The processing amount of the light-sensitive material was 10 $m^2$ per day. The sensitometric sensitivity was determined at the times of start and after 5 days running.

The evaluation was carried out in the same manner as in Example 1 except that the followings.

Sensitometry

For evaluation of photographic characteristics, the film was set between intensifying screens for orthochromatic film and wedgewise exposed to X-ray. The sensitivity was expressed by relative value when the sensitivity of the comparative sample 301 was set as 100.

Evaluation of gradation: Tangent of density of fog+0.25 to that of 2.0 in the characteristic curve was measured to evaluation of gradation.

Results of the evaluation are shown below.

| Sample No. | Support | Thickness | Adhesive layer |
|---|---|---|---|
| 301 (Comparative) | PET | 130 μm | Vinylidene chloride |
| 302 (Comparative) | PET | 130 μm | Styrene/glycidyl acrylate |
| 303 (Inventive) | SPS | 130 μm | Vinylidene chloride |
| 304 (Inventive) | SPS | 130 μm | Styrene/butadiene |
| 305 (Inventive) | SPS | 130 μm | Styrene/glycidyl acrylate |
| 306 (Inventive) | SPS | 130 μm | Gelatin |

| Sample | Dryness | | Sens. | | Gamma | | Fog | | |
|---|---|---|---|---|---|---|---|---|---|
| No. | Be. | Af. | Be. | Af. | Be. | Af. | Be. | Af. | |
| 301 | 4 | 3 | 100 | 75 | 2.7 | 1.5 | 0.04 | 0.12 | Comp. |
| 302 | 4 | 3 | 100 | 75 | 2.7 | 1.5 | 0.04 | 0.12 | Comp. |
| 303 | 5 | 5 | 100 | 102 | 2.7 | 2.7 | 0.04 | 0.04 | Inv. |
| 304 | 5 | 5 | 100 | 102 | 2.7 | 2.7 | 0.04 | 0.04 | Inv. |
| 305 | 5 | 5 | 100 | 103 | 2.7 | 2.7 | 0.04 | 0.04 | Inv. |
| 306 | 4 | 4 | 100 | 95 | 2.5 | 2.5 | 0.04 | 0.06 | Inv. |

(In the above, "Be." and "Af." are each means "Before running of processing" and After running of processing", respectively)

It is understood that in the silver halide photographic light-sensitive material for medical X-ray film using a SPS support, degradation in the dryness, variation in the sensitivity and contrast, and increasing in fogging are small, even when a lot of the light-sensitive material is processed in an automatic processing machine while replenishing with lowered amounts of developer replenished and fixer replenisher.

What is claimed is:

1. A method for processing a silver halide photographic light-sensitive material by an automatic processor comprising the steps of imagewise exposing a sivlver halide photographic light-sensitive material to light developing said imagewise exposed silver halide photographic light-sensitive material with a developer being in a developing tank of said automatic processor while replenishing a developer replenisher in a rate of from 50 ml to 330 ml per square meter of the light-sensitive material and fixing said developed silver halide photographic light-sensitive material with a fixer being in a fixing tank of said automatic processor while replenishing a fixer replenisher in a rate of from 50 ml to 330 ml per square meter of the light-sensitive material, wherein said silver halide photographic light-sensitive material comprises a support and at least one silver halide emulsion layer provided on a surface of a support which is a stretched film composed of a styrene copolymer having a syndiotactic structure or a composition containing said styrene copolymer.

2. The method of claim 1, wherein said developer contains substantially no dihydroxybenzene compound and contains a compound represented by the following Formula (I);

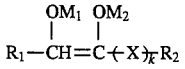

Formula (I)

wherein, $R_1$ and $R_2$ represent each independently an alkyl group, an amino group, an alkoxyl group, an alkylthio group, $R_1$ may be linked together with $R_2$ to form a ring; k is an integer of 0 or 1; and X represents —CO— or —CS— when k=1; $M_1$ and $M_2$ represent each a hydrogen atom or an alkali metal atom.

3. The method of claim 2, wherein said compound represented by Formula (I) is a compound represented by Formula (I-a);

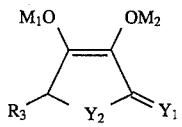

Formula (I-a)

wherein $R_3$ is an alkyl group, an aryl group, an alkoxyl group, a sulfo group, a carboxyl group, an amido group or a sulfonamido group; $Y_1$ is O or S; $Y_2$ is O, S or $NR_4$, $R_4$ is an alkyl group or an aryl group.

4. The method of claim 1, wherein said developer contains substantially no dihydroxybenzene compound and contains a developing agent composed of a complex salt of a transition metal.

5. The method of claim 1, wherein said developer is one prepared by dissolving a solid developing composition in water.

6. The method of claim 1, wherein said replenishing to said developer is carried out by directly supplying a solid developer replenishing composition to the developer being in the automatic processor according to the processed amount of the light-sensitive material.

7. The method of claim 1, wherein said fixer contains substantially no aluminum salt.

8. The method of claim 1, wherein said fixer is one prepared by dissolving a solid fixing composition in water.

9. The method of claim 1, wherein said replenishing to said fixer is carried out by directly supplying a solid fixer replenishing composition to the fixer being in the automatic processor according to the processed amount of the light-sensitive material.

10. The method of claim 1, wherein said silver halide photographic light-sensitive material contains a hydrazine compound in the silver halide emulsion or a hydrophilic colloid layer provided on the side of the support on which said silver halide emulsion layer is provided.

11. The method of claim 10, wherein said hydrazine compound is a compound represented by the following Formula H

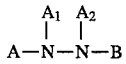

Formula H wherein A is an aliphatic group, an aromatic group or a heterocyclic group; B is an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, an oxalyl group or a heterocyclic group; $A_1$ and $A_2$ are each independently a hydrogen atom, an acyl group, a sulfonyl group or an oxalyl group, provided that at least on of them is a hydrogen atom; and A2 and B and a nitrogen atom liked with them may be form a partial structure of hydrazone —N=C<.

12. The method of claim 11, wherein said silver halide photographic light-sensitive material contains a nucleation accelerating compound selected from amino compounds, quartenary onium compounds and alcohol compounds in the silver halide emulsion or a hydrophilic colloid layer provided on the side of the support on which said silver halide emulsion layer is provided.

13. The method of claim 12, wherein said nucleation accelerating compound is a compound represented by the following Formula B-1;

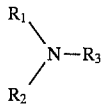

wherein $R_1$, $R_2$ and $R_3$ are each independently a hydrogen atom, an alkyl group, an alkenyl group, an alkynyl group, an aryl group, the above alkyl group, alkenyl group and aryl group each may have a substituent, $R_1$, $R_2$ and $R_3$ may be linked to form a ring.

14. The method of claim 12, wherein said nucleation accelerating compound is a compound represented by the following Formula B-2;

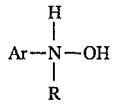

wherein Ar is an alkyl group which may have a substituent, or an aromatic heterocyclic group, R is an alkyl group, an alkenyl group, an alkynyl group or an aryl group.

15. The method of claim 1, wherein said silver halide photographic light-sensitive material contains a tetrazolium compound in the silver halide emulsion or a hydrophilic colloid layer provided on the side of the support on which said silver halide emulsion layer is provided.

16. The method of claim 15, wherein said tetrazolium compound is a compound represented by the following Formula T;

Formula T

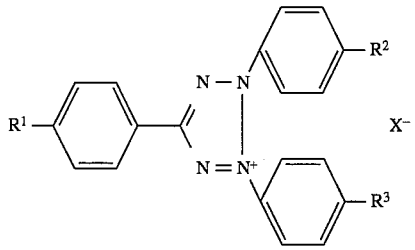

wherein are each independently a hydrogen atom or a group having a negative $\sigma_p$ value of Hammett; and $X^-$ is an anion.

17. The method of claim 1, wherein said developer contains a compound represented by the following Formula (2);

Formula (2)

$$Z_1—SM_1$$

In the formula, $Z_1$ represents an alkyl group, an aromatic group or a heterocyclic group, each of which has a substituent selected from the group consisting of a hydroxyl group, $—SO_3M_1'$, $—COOM_1'$, in which $M_1'$ is a hydrogen atom, an alkali metal atom or an ammonium ion, an amino group and an ammonio group, or a group substituted with at least one substituent selected from the above group; $M_1$ represents a hydrogen atom, an alkali metal atom, an amidino group which may be in a form of a hydrogen halide salt or a sulfonate.

18. The method of claim 17, wherein said developer contains a compound represented by the following Formula (2-a);

Formula (2-a)

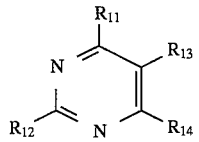

wherein, $R_{11}$, $R_{12}$, $R_{13}$ and $R_{14}$ are each independently a hydrogen atom, a halogen atom, an alkyl group, an alkoxyl group, an aryl group, an aralkyl group, a hydroxyl group, a mercapto group, a carboxyl group, a sulfo group, a phosphono group, an amino group, a nitro group, a cyano group, an alkoxycarbonyl group, an aryloxycarbonyl group, a carbamoyl group or a sulfamoyl group, provided that at least one of $R_{11}$, $R_{12}$, $R_{13}$ and $R_{14}$ is a mercapto group and at least one of $R_{11}$, $R_{12}$, $R_{13}$ and $R_{14}$ other than one representing the mercapto group is a hydroxyl group or an amino group, $R_{13}$ and $R_{14}$ may be linked to form a saturated or unsaturated ring.

19. The method of claim 17, wherein said developer contains a compound represented by the following Formula (2-b) or Formula (2-c);

Formula (2-b)

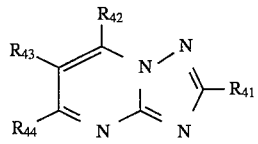

Formula (2-c)

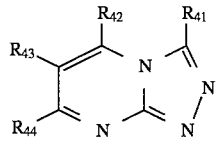

In Formulas (2-b) and (2-c), $R_{41}$, $R_{42}$, $R_{43}$ and $R_{44}$ are each independently a hydrogen atom, an $—SM_{41}$ group, a hydroxyl group, an alkoxyl group having 1 to 5 carbon atoms, a $—COOM_{42}$ group, an amino group, an $—SO_3M_{43}$ group or an alkyl group having 1 to 5 carbon atoms, and at least one of $R_{41}$, $R_{42}$, $R_{43}$ and $R_{44}$ is an $—SM_{41}$ group, $M_{41}$, $M_{42}$ and $M_{43}$ are each a hydrogen atom, an alkali metal atom or an ammonium group, they may be the same or different.

* * * * *